US007536117B2

(12) United States Patent
Kishi

(10) Patent No.: US 7,536,117 B2
(45) Date of Patent: May 19, 2009

(54) IMAGE-FORMING DEVICE AND DEVELOPING CARTRIDGE WITH INFORMATION MEMBER FOR USE THEREIN

(75) Inventor: Isao Kishi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 381 days.

(21) Appl. No.: 11/362,163

(22) Filed: Feb. 27, 2006

(65) Prior Publication Data

US 2006/0193645 A1 Aug. 31, 2006

(30) Foreign Application Priority Data

Feb. 28, 2005 (JP) ..... 2005-055103

(51) Int. Cl.
*G03G 15/00* (2006.01)

(52) U.S. Cl. ..... 399/12; 399/13

(58) Field of Classification Search ..... 399/12, 399/13

See application file for complete search history.

(56) References Cited

U.S. PATENT DOCUMENTS

| | | | | |
|---|---|---|---|---|
| 4,500,195 | A | 2/1985 | Hosono | |
| 5,384,629 | A | 1/1995 | Watanabe et al. | |
| 6,298,202 | B1 * | 10/2001 | Fushiya et al. | 399/12 |
| 6,330,402 | B1 | 12/2001 | Sakurai et al. | |
| 7,116,919 | B2 * | 10/2006 | Ishii | 399/12 |
| 7,212,750 | B2 * | 5/2007 | Kawai | 399/12 |
| 7,319,827 | B2 * | 1/2008 | Yoshizawa | 399/12 |
| 2005/0031359 | A1 | 2/2005 | Ishii | |

FOREIGN PATENT DOCUMENTS

| | | |
|---|---|---|
| EP | 0 577 416 A1 | 1/1994 |
| EP | 1 505 459 A1 | 2/2005 |
| JP | A-07-134497 | 5/1995 |
| JP | A-09-185254 | 7/1997 |
| JP | A-2000-162929 | 6/2000 |
| JP | A-2000-221781 | 8/2000 |
| JP | A-2001-83846 | 3/2001 |
| JP | A-2002-049291 | 2/2002 |
| JP | A 2002-278249 | 9/2002 |
| JP | A-2003-140453 | 5/2003 |

* cited by examiner

*Primary Examiner*—William J Royer
(74) *Attorney, Agent, or Firm*—Oliff & Berridge, PLC

(57) ABSTRACT

An image-forming device includes a body, a developer cartridge, a first detecting unit, a second detecting unit and a controller. The developer cartridge accommodates developer therein and is detachable from the body. The developer cartridge includes an information member disposed, when the developer cartridge is mounted on the body, in at least one of a first position and a second position different from the first position in accordance with information with respect to the developer cartridge. The first detecting unit detects that the information member is disposed at the first position. The second detecting unit detects that the information member is disposed at the second position. The controller determines the information with respect to the developer cartridge based on the detecting result of at least one of the first detecting unit and the second detecting unit.

44 Claims, 18 Drawing Sheets

IMAGE-FORMING DEVICE AND DEVELOPING CARTRIDGE WITH INFORMATION MEMBER FOR USE THEREIN

CROSS REFERENCE TO RELATED APPLICATION

This application claims priority from Japanese Patent Application No. 2005-055103, filed Feb. 28, 2005, the entire subject matter of which is incorporated herein by reference.

BACKGROUND OF THE INVENTION

1. Field of the Invention

The present invention relates to an image-forming device such as a laser printer, and a developer cartridge detachably mounted in the image-forming device.

2. Description of Related Art

In conventional laser printers, developer cartridges accommodating toner are detachably mounted therein. This type of laser printer is provided with new product detecting means for detecting whether the developer cartridge mounted in the laser printer is a new product and for determining the life of the developer cartridge from the point that the new product was detected.

For example, Japanese unexamined patent application publication No. 2000-221781proposes a developing device in which is provided a sector gear having a recessed part and a protruding part. When a new developing device is mounted in the body of an electrophotographic image-forming device, the protruding part formed on the sector gear is inserted into a new product side sensor, turning the new product side sensor on. After the developing device has been mounted in the body of the image-forming device, an idler gear is driven to rotate. When the idler gear begins to rotate, the sector gear also rotates, moving the protruding part from the new product side sensor to an old product side sensor. The protruding part is inserted into the old product side sensor, turning the old product side sensor on. At the same time, the idler gear arrives at the recessed part of the sector gear, and the sector gear stops rotating.

However, some users have requested the freedom to select an optimum developer cartridge from a plurality of developer cartridges in different price ranges corresponding to the amount toner accommodated therein with consideration for cost and frequency of use. To meet this demand, developer cartridges accommodating different amounts of toner must be provided. However, the toner accommodated in these developer cartridges has different agitation properties and different rates of degradation based on the amount of toner.

Under these circumstances, it is not sufficient merely to detect whether the developer cartridge is a new product since the life of the developer cartridge from this point of detection may differ according to the amount of toner accommodated therein. Accordingly, the life of the developer cartridge cannot be accurately determined. As a result, a developer cartridge accommodating a small amount of toner may actually reach the end of its life before such a determination is made, resulting in a decline in image quality.

SUMMARY

In view of the above-described drawbacks, it is an objective of one aspect of the present invention to provide an image-forming device capable of determining a plurality of data items on a developer cartridge, and a developer cartridge detachably mounted in the image-forming device.

In order to attain the above and other objects, one aspect of the present invention provides an image-forming device including a body, a developer cartridge, a first detecting unit, a second detecting unit and a controller. The developer cartridge accommodates developer therein and is detachable from the body. The developer cartridge includes an information member disposed, when the developer cartridge is mounted on the body, in at least one of a first position and a second position different from the first position in accordance with information with respect to the developer cartridge. The first detecting unit detects that the information member is disposed at the first position. The second detecting unit detects that the information member is disposed at the second position. The controller determines the information with respect to the developer cartridge based on the detecting result of at least one of the first detecting unit and the second detecting unit.

Another aspect of the present invention provides a developer cartridge detachable from an image-forming device. The developer cartridge includes an accommodating member and an information member. The accommodating member accommodates developer therein. The information member disposed, when the developer cartridge is mounted on the image-forming device, in at least one of a first position and a second position different from the first position in accordance with information with respect to the developer cartridge. A position at which the information member is disposed is used to determine information with respect to the developer cartridge.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

An image-forming device according to preferred embodiments of the present invention will be described while referring to the accompanying drawings.

1. General Structure of a Laser Printer

Figure 1:
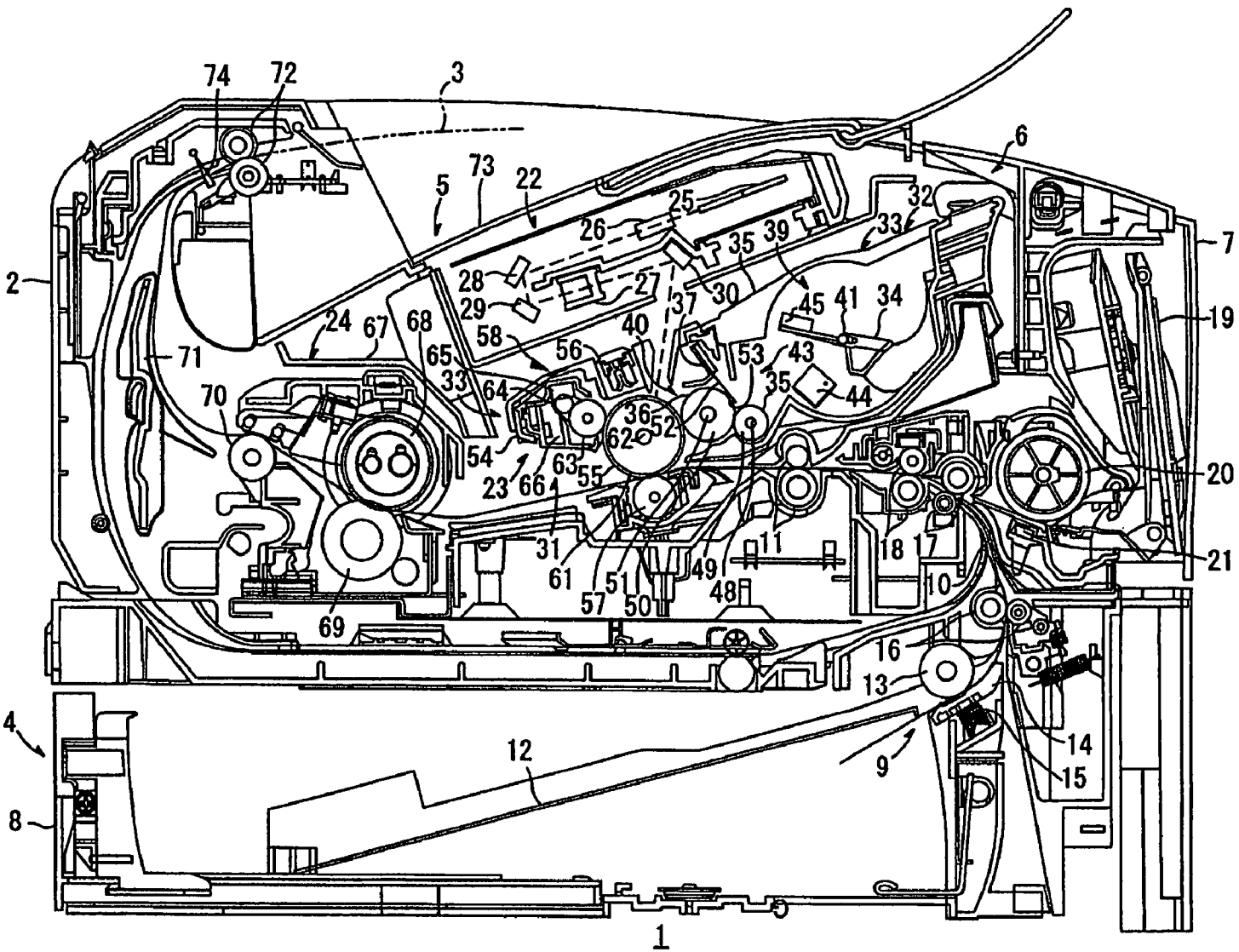
FIG. 1 is a side cross-sectional view of a laser printer as a preferred embodiment of the present invention.

FIG. 1 is a side cross-sectional view of a laser printer 1 serving as the image-forming device of the present invention. As shown in FIG. 1, the laser printer 1 includes a main casing 2 and, within the main casing 2, a feeding unit 4 for supplying sheets 3 of paper, an image-forming unit 5 for forming images on the sheets 3 supplied from the feeding unit 4, and the like.

(1) Main casing

An access opening 6 is formed in one side surface (the right side in FIG. 1) of the main casing 2 for inserting and removing a process unit 23 described later. A front cover 7 is disposed on the side surface of the main casing 2 and is capable of opening and closing over the access opening 6. The front cover 7 is rotatably supported by a cover shaft (not shown) inserted through a bottom end of the front cover 7. When the front cover 7 is rotated closed about the cover shaft, the front cover 7 covers the access opening 6, as shown in FIG. 1. When the front cover 7 is rotated open about the cover shaft (rotated downward), the access opening 6 is exposed, enabling the process unit 23 to be mounted into or removed from the main casing 2 via the access opening 6.

In the following description, the side of the laser printer 1 on which the front cover 7 is mounted and the corresponding side of the process unit 23 when the process unit 23 is mounted in the main casing 2 will be referred to as the "front side," while the opposite side will be referred to as the "rear side."

(2) Feeding unit

The feeding unit 4 includes a paper tray 8, a paper-feeding mechanism 9 disposed on the front side of the paper tray 8, a feeding end paper-conveying path 10 for conveying the sheets 3 to a transfer position (a position at which a nip part is formed between a photosensitive drum 55 and a transfer roller 57 described later), and a pair of registration rollers 11.

The paper tray 8 has an open-top box shape that is capable of accommodating stacked sheets 3 of paper. The paper tray 8 can be mounted in or removed from a bottom section of the main casing 2 in a horizontal direction. A paper-pressing plate 12 is disposed inside the paper tray 8 for supporting the sheets 3 in a stacked state. An end of the paper-pressing plate 12 farthest from the paper-feeding mechanism 9 is pivotably supported in the paper tray 8, while the end nearest the paper-feeding mechanism 9 is capable of moving vertically. A spring (not shown) is disposed on the underside of the paper-pressing plate 12 for urging the paper-pressing plate 12 upward. As the amount of sheets 3 stacked on the paper-pressing plate 12 increases, the paper-pressing plate 12 opposes the urging force of the spring and pivots downward about the end farthest from the paper-feeding mechanism 9.

The paper-feeding mechanism 9 includes a feeding roller 13, a separating pad 14 disposed in opposition to the feeding roller 13, and a spring 15 disposed on the underside of the separating pad 14. The urging force of the spring 15 presses the separating pad 14 toward the feeding roller 13.

As the spring urges the paper-pressing plate 12 upward, the topmost sheet 3 on the paper-pressing plate 12 is pressed toward the feeding roller 13. As the feeding roller 13 rotates, the leading edge of the sheet 3 becomes interposed between the feeding roller 13 and the separating pad 14 and is separated one sheet at a time by the cooperative operations of the feeding roller 13 and separating pad 14. The separated sheet 3 is fed onto the feeding end paper-conveying path 10.

The feeding end paper-conveying path 10 is substantially U-shaped in a side view. Conveying rollers 16, 17, and 18 are provided along the feeding end paper-conveying path 10. When a sheet 3 is fed onto the feeding end paper-conveying path 10, the conveying rollers 16, 17, and 18 convey the sheet 3 to the registration rollers 11.

The registration rollers 11 are disposed rearward of the feeding end paper-conveying path 10 (downstream in the paper-conveying direction). The registration rollers 11 correct the registration of the sheet 3 before conveying the sheet 3 to the transfer position.

The feeding unit 4 of the laser printer 1 also includes a multipurpose tray 19 in which sheets 3 of a desired size can be stacked, a multipurpose feeding roller 20 for supplying the sheets 3 stacked on the multipurpose tray 19, and a multipurpose separating pad 21 disposed in opposition to the multipurpose feeding roller 20. The multipurpose tray 19 is foldable so as to be accommodated in the front cover 7.

(3) Image-forming unit

The image-forming unit 5 includes a scanning unit 22, the process unit 23, and a fixing unit 24.

(a) Scanning unit

The scanning unit 22 is disposed in an upper section of the main casing 2 and includes a laser light-emitting unit (not shown), a polygon mirror 25 that can be driven to rotate, lenses 26 and 27, and reflecting mirrors 28, 29, and 30.

In the scanning unit 22 having this construction, a laser beam modulated by prescribed image data is emitted from the laser light-emitting unit and, as indicated by a dotted line in FIG. 1, sequentially passes through or reflects off the polygon mirror 25, lens 26, reflecting mirror 28 and 29, lens 27, and reflecting mirror 30 in the order given and is irradiated onto the surface of the photosensitive drum 55 in the process unit 23.

(b) Process unit

The process unit 23 is detachably mounted in the main casing 2 below the scanning unit 22.

Figure 2:
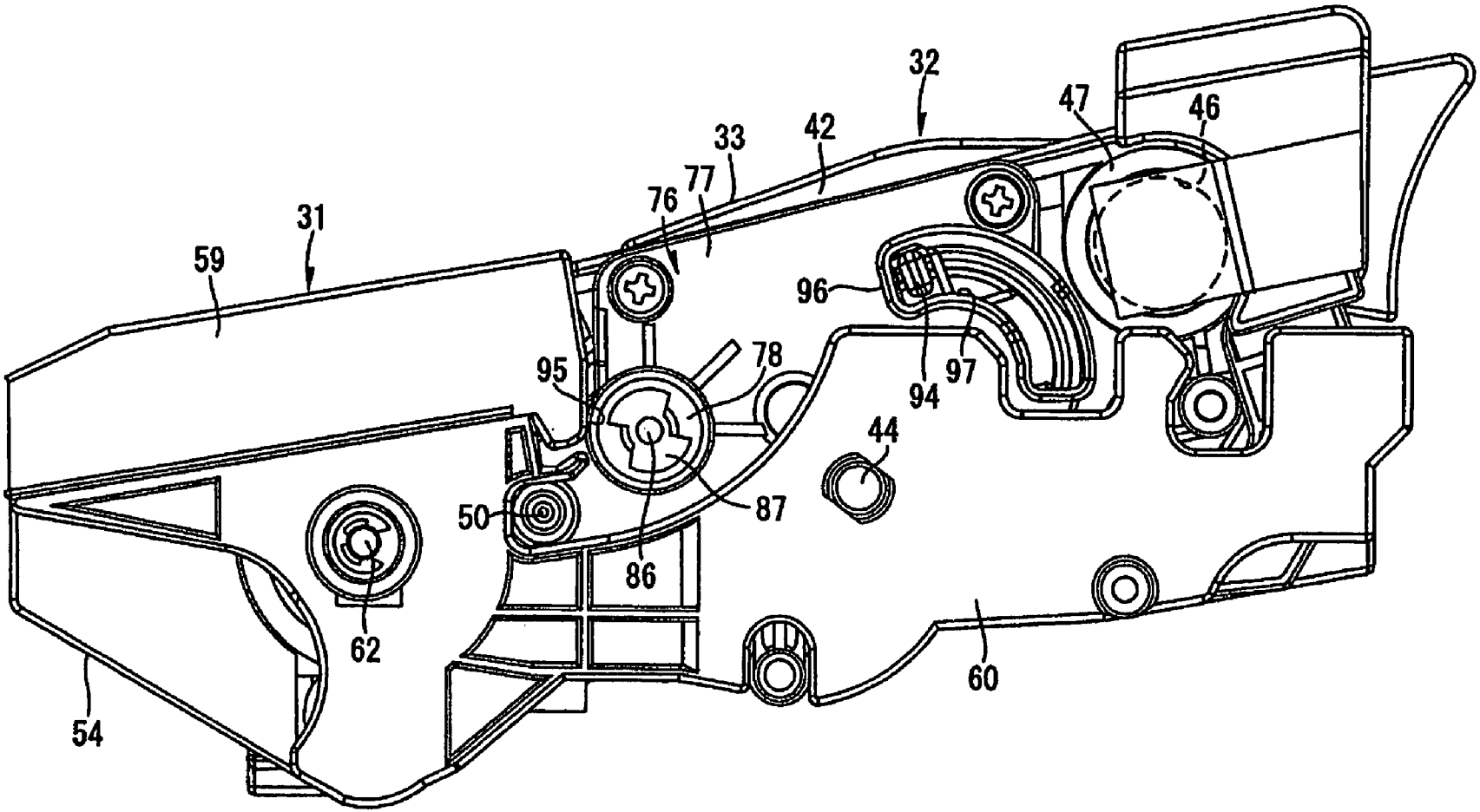
FIG. 2 is a side view of a process unit provided in the laser printer in FIG. 1.

As shown in FIG. 2, the process unit 23 includes a drum cartridge 31 that is detachably mounted in the main casing 2, and a developer cartridge 32 detachably mounted on the drum cartridge 31.

(c) Developer cartridge

The developer cartridge 32 is detachably mounted on a cartridge-mounting section 60 (see FIG. 2) described later of the drum cartridge 31. When the drum cartridge 31 is mounted in the main casing 2, the developer cartridge 32 can be mounted in the main casing 2 by first opening the front cover 7 and subsequently inserting the developer cartridge 32 through the access opening 6 and mounting the developer cartridge 32 on the drum cartridge 31.

As shown in FIG. 1, the developer cartridge 32 includes a casing 33, an agitator 34 provided in the casing 33, a supply roller 35, a developing roller 36, and a thickness-regulating blade 37.

The casing 33 has a box shape that is open on the rear side. A partition member 43 is provided midway in the casing 33 in the front-to-rear direction for partitioning the interior of the casing 33. The front region of the casing 33 partitioned by the partition member 43 serves as a toner-accommodating chamber 39 for accommodating toner, while the rear region of the casing 33 partitioned by the partition member 43 serves as a developing chamber 40 in which are provided the supply roller 35, developing roller 36, and thickness-regulating blade 37.

The toner-accommodating chamber 39 accommodates a positively charged nonmagnetic single-component toner. The toner is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The polymerized toner is formed as particles substantially spherical in shape and having excellent fluidity so as to achieve high-quality image formation. The toner is compounded with a coloring agent such as carbon black, or wax, as well as an additive such as silica to improve fluidity.

An agitator rotational shaft 41 is disposed in the center of the toner-accommodating chamber 39. The agitator rotational shaft 41 is rotatably supported in side walls 42 (see FIG. 2) of the casing 33, opposing but separated from one another laterally (direction orthogonal to the front-to-rear direction and vertical direction; see FIG. 4).

The agitator 34 is provided on the agitator rotational shaft 41 inside the toner-accommodating chamber 39. A motor 75 (see FIG. 5) produces a driving force that is inputted into the agitator rotational shaft 41 for driving the agitator 34 to rotate. When driven to rotate, the agitator 34 stirs the toner inside the toner-accommodating chamber 39 so that some of the toner is discharged through the partition member 43 toward the supply roller 35.

Toner detection windows 44 (see FIG. 3) are provided in both side walls 42 of the casing 33 at positions corresponding to the toner-accommodating chamber 39 for detecting the amount of toner remaining in the toner-accommodating chamber 39. The toner detection windows 44 oppose each other laterally across the toner-accommodating chamber 39. A light-emitting element (not shown) is provided on the main casing 2 outside one of the toner detection windows 44, while a light-receiving element (not shown) is provided on the main casing 2 outside the other of the toner detection windows 44. Light emitted from the light-emitting element passes into the toner-accommodating chamber 39 through one of the toner detection windows 44. The light-receiving element detects this light as detection light when the light passes through the toner-accommodating chamber 39 and exits the other toner detection window 44. The laser printer 1 can determine the amount of remaining toner based on the frequency that the light-receiving element detects this detection light.

A wiper element 45 is disposed on the agitator 34 for cleaning these toner detection windows 44.

A toner-filling hole 46 (see FIG. 2) is formed in one of the side walls 42 at a position corresponding to the toner-accommodating chamber 39 for introducing toner into the toner-accommodating chamber 39. The toner-filling hole 46 is circular in shape and penetrates the thickness of the side wall 42. A cap 47 (see FIG. 2) is provided for covering the toner-filling hole 46.

As shown in FIG. 1, the supply roller 35, developing roller 36, and thickness-regulating blade 37 are disposed in the developing chamber 40.

The supply roller 35 is disposed rearward of the partition member 43 and includes a metal supply roller shaft 48 covered by a sponge roller 49 formed of an electrically conductive foam material. The supply roller shaft 48 is rotatably supported in both side walls 42 of the casing 33 at a position corresponding to the developing chamber 40. The supply roller 35 is driven to rotate by a driving force inputted into the supply roller shaft 48 from the motor 75.

The developing roller 36 is disposed rearward of the supply roller 35 and contacts the supply roller 35 with pressure so that both are compressed. The developing roller 36 includes a metal developing roller shaft 50, and a rubber roller 51 formed of an electrically conductive rubber material that covers the developing roller shaft 50. The developing roller shaft 50 is rotatably supported in both side walls 42 of the casing 33 at a position corresponding to the developing chamber 40. The rubber roller 51 is more specifically formed of an electrically conductive urethane rubber or silicon rubber containing fine carbon particles, the surface of which is coated with urethane rubber or silicon rubber containing fluorine. The developing roller 36 is driven to rotate by a driving force inputted into the developing roller shaft 50 from the motor 75. A developing bias is applied to the developing roller 36 during a developing operation.

The thickness-regulating blade 37 includes a blade member 52 formed of a metal leaf spring member, and a pressing part 53 provided on the free end of the blade member 52, the pressing part 53 having a substantially semicircular cross section and being formed of an electrically insulating silicon rubber. A base end of the blade member 52 is supported on the casing 33 above the developing roller 36. The pressing part 53 is pressed against the developing roller 36 by the elastic force of the blade member 52.

Toner discharged through the partition member 43 is supplied onto the developing roller 36 by the rotation of the supply roller 35. At this time, the toner is positively tribo-charged between the supply roller 35 and developing roller 36. As the developing roller 36 continues to rotate, the toner supplied onto the surface of the developing roller 36 passes between the pressing part 53 of the thickness-regulating blade 37 and the rubber roller 51 of the developing roller 36, so that a thin layer of uniform thickness is carried on the developing roller 36.

(c) Drum cartridge

As shown in FIG. 1, the drum cartridge 31 includes a drum frame 54, the photosensitive drum 55, a Scorotron charger 56, the transfer roller 57, and a cleaning member 58. The photosensitive drum 55, the Scorotron charger 56, the transfer roller 57, and the cleaning member 58 are disposed in the drum frame 54.

As shown in FIG. 2, a rear section of the drum frame 54 serves as a drum-accommodating section 59 for accommodating the photosensitive drum 55, Scorotron charger 56, transfer roller 57, and cleaning member 58. The front section of the drum frame 54 serves as the cartridge-mounting section 60 having an open top in which the developer cartridge 32 is detachably mounted.

As shown in FIG. 1, the photosensitive drum 55 is disposed rearward of the developing roller 36 in confrontation with the same. The photosensitive drum 55 is cylindrical in shape and is configured of a main drum body 61 formed of a positive charging photosensitive layer of polycarbonate or the like on the outermost layer; and a metal drum shaft 62 disposed in the axial center of the main drum body 61 and extending along the longitudinal direction of the same. The drum shaft 62 is supported in the drum-accommodating section 59. By rotatably supporting the main drum body 61 on the drum shaft 62, the photosensitive drum 55 is capable of rotating about the drum shaft 62. Further, the photosensitive drum 55 is driven to rotate by a driving force inputted from the motor 75.

The charger 56 is disposed in opposition to the photosensitive drum 55 from a position above the same and is separated a prescribed distance therefrom. The charger 56 is a positive charging Scorotron type charger that produces a corona discharge from a discharge wire formed of tungsten in order to form a uniform charge of positive polarity over the surface of the photosensitive drum 55.

The transfer roller 57 is rotatably disposed in the drum-accommodating section 59 in opposition to the photosensitive drum 55 from a position below the same. The transfer roller 57 contacts and forms a nip part with the photosensitive drum 55. The transfer roller 57 includes a metal roller shaft that is covered with a rubber roller formed of an electrically conductive rubber material. A transfer bias is applied to the transfer roller 57 during a transfer operation. The transfer roller 57 is also driven to rotate by a driving force inputted from the motor 75.

The cleaning member 58 is provided in the rear portion of the drum-accommodating section 59 on the opposite side of the photosensitive drum 55 from the developing roller 36. The cleaning member 58 includes a primary cleaning roller 63 disposed in opposition to the photosensitive drum 55, a secondary cleaning roller 64 disposed in opposition to the primary cleaning roller 63, a scraping sponge 65 disposed in opposition to the secondary cleaning roller 64, and a paper dust accumulating unit 66.

As the photosensitive drum 55 rotates in the drum cartridge 31, the charger 56 charges the surface of the photosensitive drum 55 with a uniform positive polarity. Subsequently, the scanning unit 22 irradiates a laser beam based on image data inputted from an external source, to form an electrostatic latent image on the surface of the photosensitive drum 55.

Next, positively charged toner carried on the surface of the developing roller 36 comes into contact with the photosensitive drum 55 as the developing roller 36 rotates and is supplied to areas on the surface of the positively charged photosensitive drum 55 that were exposed to the laser beam and, therefore, have a lower potential. In this way, the latent image on the photosensitive drum 55 is developed into a visible image.

Hence, as the registration rollers 11 convey a sheet 3 through the transfer position between the photosensitive drum 55 and transfer roller 57, the toner carried on the surface of the photosensitive drum 55 is transferred onto the sheet 3. After the toner is transferred, the sheet 3 is conveyed to the fixing unit 24.

Toner remaining on the photosensitive drum 55 after the transfer operation is recovered by the cleaning member 58. Specifically, when toner is transferred to the sheet 3, a low bias is applied to the primary cleaning roller 63 so that toner remaining on the photosensitive drum 55 is temporarily captured on the primary cleaning roller 63.

However, when toner is not being transferred to the sheet 3, that is, during intervals between consecutively conveyed sheets 3, a high bias is applied to the primary cleaning roller 63, causing the toner temporarily captured on the primary cleaning roller 63 to return to the photosensitive drum 55 and causing paper dust deposited on the photosensitive drum 55 from the sheet 3 during a transfer operation to be captured on the primary cleaning roller 63. The developing roller 36 recovers toner returned to the photosensitive drum 55. The secondary cleaning roller 64 captures paper dust attracted to the primary cleaning roller 63 when the primary cleaning roller 63 rotates opposite the secondary cleaning roller 64. The scraping sponge 65 scrapes off paper dust captured on the secondary cleaning roller 64 when the secondary cleaning roller 64 rotates opposite the scraping sponge 65, and the paper dust is accumulated in the paper dust accumulating unit 66.

(d) Fixing unit

The fixing unit 24 is disposed rearward of the process unit 23 and downstream of the same in the paper-conveying direction. The fixing unit 24 includes a fixing frame 67, and, within the fixing frame 67, a heating roller 68, a pressure roller 69, and a pair of conveying rollers 70.

The heating roller 68 includes a metal tube, the surface of which has been coated with a fluorine resin, and a halogen lamp disposed inside the metal tube for heating the same. The heating roller 68 is driven to rotate by a driving force inputted from the motor 75.

The pressure roller 69 is disposed below and in opposition to the heating roller 68 and contacts the heating roller 68 with pressure. The pressure roller 69 is configured of a metal roller shaft covered with a rubber roller that is formed of a rubber material. The pressure roller 69 follows the rotational drive of the heating roller 68.

The conveying rollers 70 are disposed rearward of the heating roller 68 and pressure roller 69.

In the fixing unit 24, a toner image transferred onto the sheet 3 at the transfer position is fixed to the sheet 3 by heat as the sheet 3 passes between the heating roller 68 and pressure roller 69. After the toner is fixed to the sheet 3, the conveying rollers 70 convey the sheet 3 along a discharge end paper-conveying path 71.

The discharge end paper-conveying path 71 is U-shaped in a side view. Discharge rollers 72 are disposed at the downstream end of the discharge end paper-conveying path 71 for discharging the sheet 3 conveyed along the discharge end paper-conveying path 71 onto a discharge tray 73.

A paper discharge sensor 74 is disposed on the discharge end paper-conveying path 71 upstream of the discharge rollers 72. The paper discharge sensor 74 pivots each time a sheet 3 conveyed along the discharge end paper-conveying path 71 passes the paper discharge sensor 74. A CPU 99 (see FIG. 5) provided in the main casing 2 counts the number of times that the paper discharge sensor 74 pivots and stores this number as the number of printed sheets 3.

In the laser printer 1 having this construction, the CPU 99 determines whether the developer cartridge 32 mounted in the main casing 2 is a new product and determines the maximum sheets to be printed with the developer cartridge 32 (described later) when the developer cartridge 32 is new. The CPU 99 compares the actual number of printed sheets since the new developer cartridge 32 was mounted to the maximum sheets to be printed with the developer cartridge 32 and displays an out-of-toner warning on a control panel or the like (not shown) when the actual number of printed sheets approaches the maximum sheets to be printed.

Figure 3:
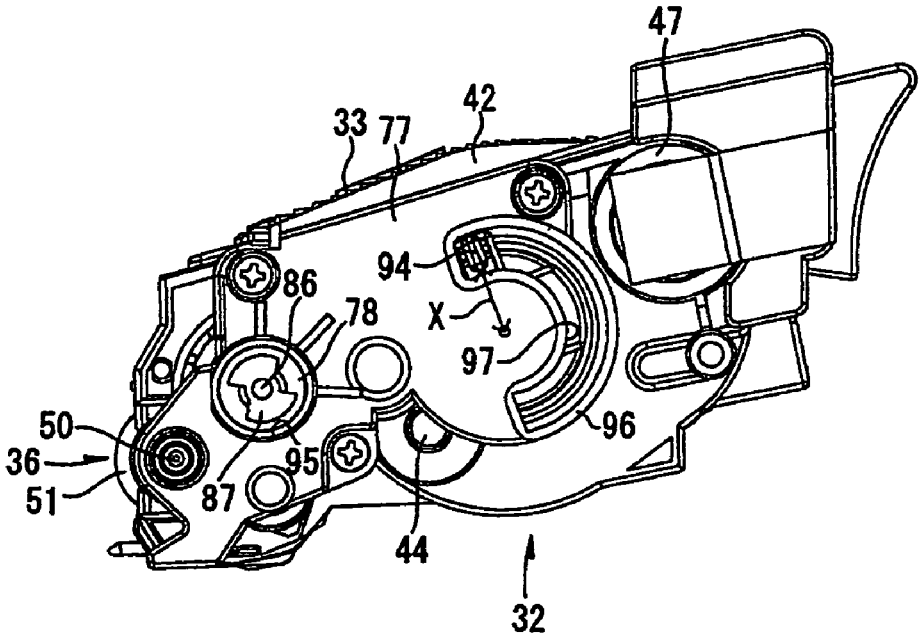
FIG. 3 is a side view of a developer cartridge provided in the process unit of FIG. 2, when a contact protrusion is in an upper position and a gear cover is mounted.
Figure 4:
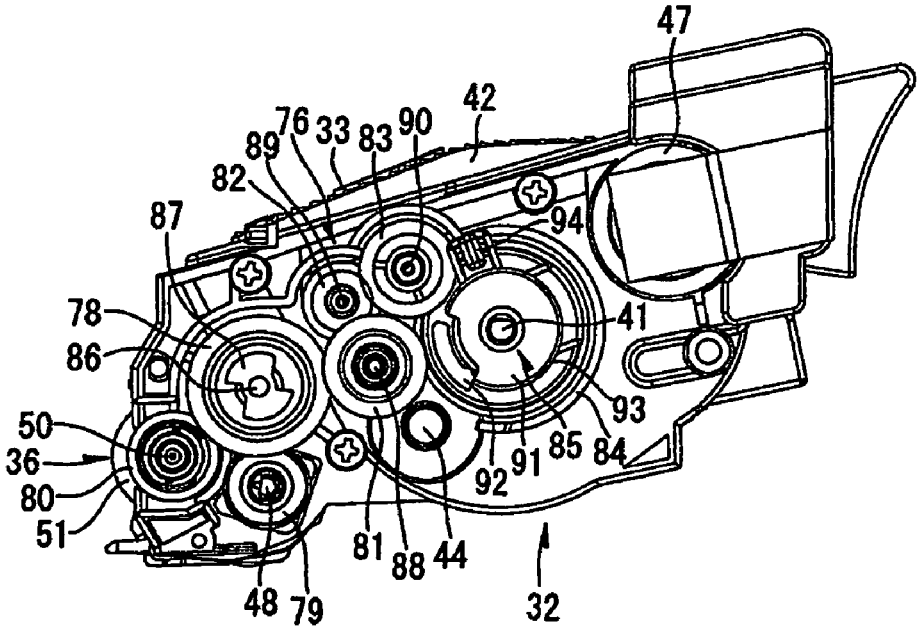
FIG. 4 is a side view of the developer cartridge, when the contact protrusion is in the upper position and the gear cover has been removed.
Figure 9:
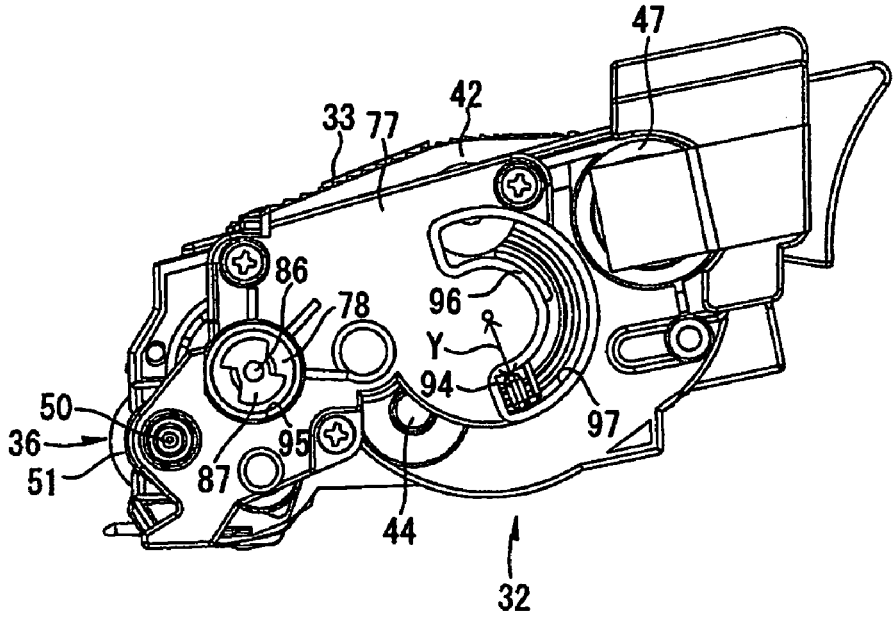
FIG. 9 is a side view of the developer cartridge when the contact protrusion is in a lower position and the gear cover is mounted.
Figure 10:
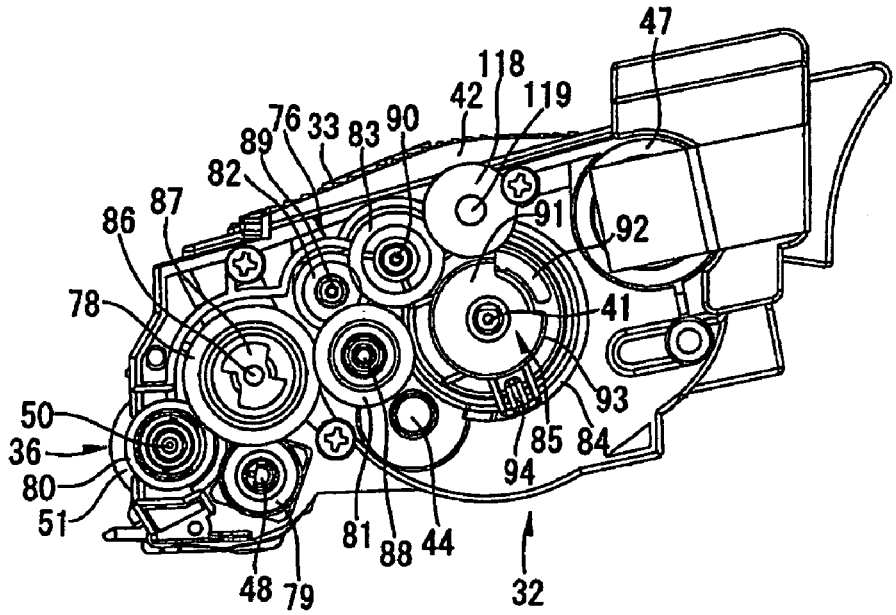
FIG. 10 is a side view of the developer cartridge when the contact protrusion is in the lower position and the gear cover has been removed.

2. Structure for Detecting a New Developer Cartridge (a) Structure of the developer cartridge FIG. 3 is a side view of the developer cartridge when a contact protrusion is in an upper position and a gear cover is mounted. FIG. 4 is a side view of the developer cartridge when the contact protrusion is in the upper position and the gear cover is removed. FIGS. 5 through 8 are explanatory diagrams illustrating a mechanism for detecting a new developer cartridge having the structure shown in FIGS. 3 and 4. FIG. 9 is a side view of the developer cartridge when the contact protrusion is in a lower position and the gear cover is mounted. FIG. 10 is a side view of the developer cartridge when the contact protrusion is in the lower position and the gear cover has been removed. FIGS. 11 through 14 are explanatory diagrams illustrating a mechanism for detecting a new developer cartridge having the structure shown in FIGS. 9 and 10.

As shown in FIG. 4, the developer cartridge 32 includes a gear mechanism 76 for rotating the rotational shaft 41 of the agitator 34, the supply roller shaft 48 of the supply roller 35, and the developing roller shaft 50 of the developing roller 36; and a gear cover 77 for covering this gear mechanism 76, as shown in FIG. 3. The form of the gear mechanism 76 differs according to the amount of toner accommodated in the developer cartridge 32.

As shown in FIG. 4, one type of the gear mechanism 76 is provided on one side wall 42 of the developing cartridge 32 in which a contact protrusion 94 (described later) is disposed in an upper position. The gear mechanism 76 includes an input gear 78, a supply roller drive gear 79, a developer roller drive gear 80, a first intermediate gear 81, a second intermediate gear 82, a third intermediate gear 83, an agitator drive gear 84, and a sensor gear 85.

The input gear 78 is disposed between the developing roller shaft 50 and the rotational shaft 41 and is rotatably supported on an input gear support shaft 86 that protrudes laterally from the outer side of one side wall 42. A coupling receiver part 87 is disposed in the axial center of the input gear 78 for inputting a driving force from the motor 75 provided on the main casing 2 (see FIG. 5) when the developer cartridge 32 is mounted in the main casing 2.

The supply roller drive gear 79 is disposed below the input gear 78 on an end of the supply roller shaft 48 so as to be engaged with the input gear 78. The supply roller drive gear 79 is incapable of rotating relative to the supply roller shaft 48.

The developing roller drive gear 80 is disposed diagonally below and rearward of the input gear 78 on an end of the developing roller shaft 50 so as to be engaged with the input gear 78. The developing roller drive gear 80 is incapable of rotating relative to the developing roller shaft 50.

The first intermediate gear 81 is rotatably supported in front of the input gear 78 on a first intermediate gear support shaft 88. The first intermediate gear support shaft 88 protrudes laterally from the outer side of one side wall 42. The first intermediate gear 81 is a two-stage gear integrally and coaxially formed with outer teeth that engage with the input gear 78 and inner teeth (not shown in the drawing) that engage with the second intermediate gear 82.

The second intermediate gear 82 is rotatably supported above the first intermediate gear 81 on a second intermediate gear support shaft 89 so as to engage with the inner teeth of the first intermediate gear 81. The second intermediate gear support shaft 89 protrudes laterally from an outer side of one of the side walls 42.

The third intermediate gear 83 is rotatably supported in front of the second intermediate gear 82 on a third intermediate gear support shaft 90. The third intermediate gear support shaft 90 protrudes laterally from an outer side of one of the side walls 42. The third intermediate gear 83 is a two-stage gear integrally and coaxially formed with outer teeth that engage with the sensor gear 85 and inner teeth (not shown in the drawing) that engage with the second intermediate gear 82.

The agitator drive gear 84 is provided diagonally in front of and below the third intermediate gear 83 on an end of the rotational shaft 41 so as to be engaged with the inner teeth of the third intermediate gear 83. The agitator drive gear 84 is incapable of rotating relative the rotational shaft 41.

The sensor gear 85 is provided on an end of the rotational shaft 41 outside of the agitator drive gear 84 in the axial direction of the rotational shaft 41 so as to overlap the agitator drive gear 84. The sensor gear 85 is capable of rotating relative to the rotational shaft 41 and is capable of engaging with the outer teeth of the third intermediate gear 83.

In the developer cartridge 32 having the contact protrusion 94 disposed on the lower side, as shown in FIG. 10, a second type of the gear mechanism 76 is provided with a fourth intermediate gear 118 in addition to the input gear 78, supply roller drive gear 79, developing roller drive gear 80, first intermediate gear 81, second intermediate gear 82, third intermediate gear 83, agitator drive gear 84, and sensor gear 85 described above.

The fourth intermediate gear 118 is rotatably supported diagonally above and in front of the third intermediate gear 83 on a fourth intermediate gear support shaft 119 so as to engage with the outer teeth of the third intermediate gear 83 and to be capable of engaging with the sensor gear 85. The fourth intermediate gear support shaft 119 protrudes laterally from an outer side of one of the side walls 42. Hence, the outer teeth of the third intermediate gear 83 engage with the fourth intermediate gear 118 but do not engage with the sensor gear 85, while the sensor gear 85 is capable of engaging with the fourth intermediate gear 118, but not capable of engaging with the outer teeth of the third intermediate gear 83.

In both the developer cartridge 32 with the contact protrusion 94 disposed in the upper position shown in FIG. 4 and the developer cartridge 32 with the contact protrusion 94 disposed in the lower position shown in FIG. 10, the sensor gear 85 is formed as a toothless gear integrally provided with a main sensor gear part 91, a toothed part 92, a toothless part 93, and the contact protrusion 94.

The main sensor gear part 91 is disc-shaped. The rotational shaft 41 is inserted through the center of the main sensor gear part 91 so that the main sensor gear part 91 is capable of rotating relative to the rotational shaft 41.

The toothed part 92 is provided on a portion of the peripheral surface of the main sensor gear part 91. Specifically, the toothed part 92 is formed from one circumferential end of the main sensor gear part 91 to another circumferential end as an arc part corresponding to about one-fourth of the peripheral surface of the main sensor gear part 91. Either the outer teeth of the third intermediate gear 83, in the example shown in FIG. 4, or the fourth intermediate gear 118, in the example shown in FIG. 10, engage with the toothed part 92 to transfer a driving force from the motor 75 (see FIG. 5).

The toothless part 93 is the remainder of the peripheral surface of the main sensor gear part 91 not occupied by the toothed part 92. When the toothless part 93 opposes either the outer teeth of the third intermediate gear 83 in the example of FIG. 4 or the fourth intermediate gear 118 in the example of FIG. 10, the outer teeth of the third intermediate gear 83 or the fourth intermediate gear 118 do not engage with the toothless part 93 and hence the transfer of the driving force from the motor 75 is interrupted.

The contact protrusion 94 expands diametrically outward from the peripheral surface of the main sensor gear part 91. The free end of the contact protrusion 94 curves outward laterally.

The contact protrusion 94 is separated a prescribed distance from the toothed part 92 on the peripheral surface of the main sensor gear part 91. The contact protrusion 94 is disposed so that the relative position of the contact protrusion 94 in the developer cartridge 32 corresponds to information on the developer cartridge 32, and specifically, information on the maximum number of sheets 3 on which images can be formed with the amount of toner accommodated in the toner-accommodating chamber 39 (hereinafter referred to as the maximum sheets to be printed) when the developer cartridge 32 is new.

More specifically, when the contact protrusion 94 is disposed on the upper side (upstream of the toothed part 92 in the rotational direction of the sensor gear 85), as shown in FIGS. 3 and 4, as a first position and a starting position, the position of the contact protrusion 94 corresponds to information indicating that the maximum sheets to be printed is 6000. When the contact protrusion 94 is in the lower position (downstream of the toothed part 92 in the rotational direction of the sensor gear 85) serving as a second position and a starting position, the position of the contact protrusion 94 corresponds to information indicating that the maximum sheets to be printed is 3000.

The sensor gear 85 is mounted on an axial end of the rotational shaft 41 and is capable of rotating relative to the rotational shaft 41 so that the toothed portion 92 of the sensor gear 85 is positioned so as not to engage with the outer teeth of the third intermediate gear 83 and upstream of the outer teeth on the third intermediate gear 83 with respect to the rotational direction of the sensor gear 85 (new product position) in the example of FIG. 4, or so as not to engage with the fourth intermediate gear 118 and upstream of the fourth intermediate gear 118 with respect to the rotational direction of the sensor gear 85 (new product position) in the example of FIG. 10.

More specifically, a first distance from the axial center of the rotational shaft 41 to the contact protrusion 94 when the contact protrusion 94 is disposed in the upper position shown in FIG. 3 (indicated by a X in FIG. 3) is essentially the same as a second distance from the axial center of the rotational shaft 41 to the contact protrusion 94 when the contact protrusion 94 is disposed in the lower position shown in FIG. 9 (indicated by a Y in FIG. 9). Even more specifically, the axial center of the rotational shaft 41 is interposed between the contact protrusion 94 disposed in the upper position and the contact protrusion 94 disposed in the lower position so that a line segment connecting the contact protrusion 94 in the upper position to the axial center of the rotational shaft 41 (indicated by X in FIG. 3) and a line segment connecting the contact protrusion 94 in the lower position to the axial center of the rotational shaft 41 (indicated by a Y in FIG. 9) form an obtuse angle. Even more, the upper position and the lower position are set such that a line segment connecting the upper position and the lower position passes over the rotational shaft 41.

As shown in FIGS. 3 and 9, the gear cover 77 is mounted on one of the side walls 42 of the developer cartridge 32 for covering the gear mechanism 76. An opening 95 is formed in the rear side of the gear cover 77 for exposing the coupling receiver part 87, Further, a sensor gear cover 96 is formed on the front side of the gear cover 77 for covering the sensor gear 85.

The sensor gear cover 96 accommodates the sensor gear 85. A sensing window 97 having a substantially semicircular arc shape is formed in a rear side portion of the sensor gear cover 96 for exposing the contact protrusion 94. The contact protrusion 94 moves in a circumferential direction along the sensing window 97 together with the rotation of the sensor gear 85.

The sensing window 97 is formed as a continuous path from the position of the contact protrusion 94 upstream of the toothed part 92 shown in FIG. 3 and the position of the contact protrusion 94 downstream of the toothed part 92 shown in FIG. 9 so that a circumferential path for the contact protrusion 94 is secured whether the contact protrusion 94 is upstream of the toothed part 92 or downstream of the toothed part 92. Further, the opening width of the sensing window 97 is set so as to contact and apply resistance to the contact protrusion 94 when the contact protrusion 94 is in an old product position (described later) so that the halted status of the sensor gear 85 can be maintained, even when the rotational shaft 41 rotates relative to the sensor gear 85.

(b) Structure of the main casing

Figure 5:
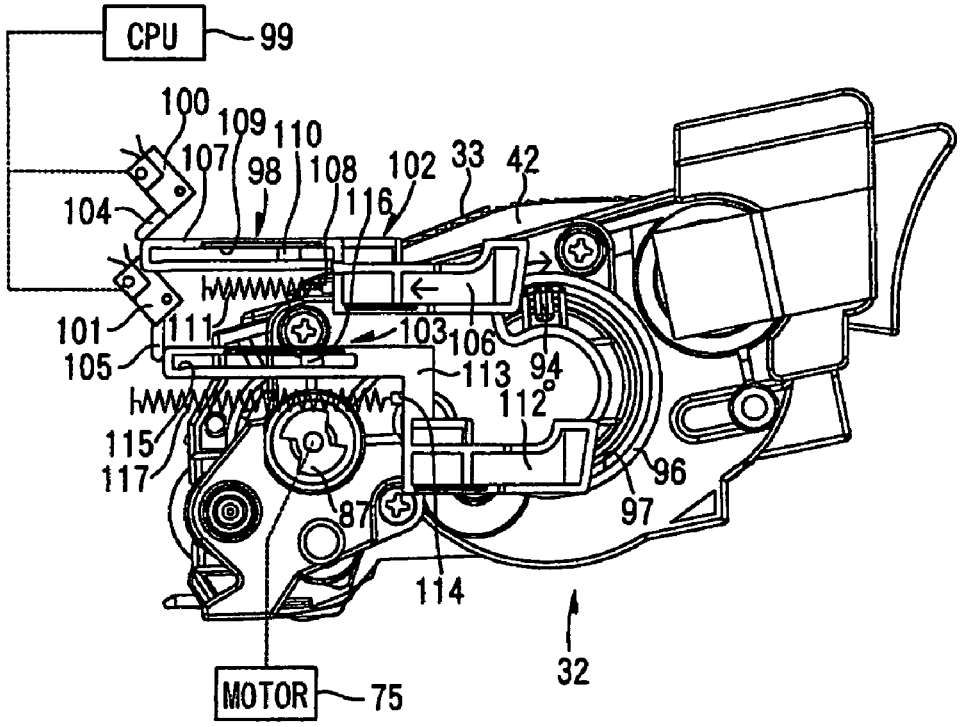
FIG. 5 is an explanatory diagram illustrating a mechanism for detecting a new developer cartridge having the structure shown in FIG. 3.

As shown in FIG. 5, an information-detecting mechanism 98 and the CPU 99 are provided on the main casing 2 for detecting and determining information on the developer cartridge 32 mounted in the main casing 2. More specifically, the information-detecting mechanism 98 and CPU 99 detect and determine data indicating whether the mounted developer cartridge 32 is a new product, and information on the maximum sheets to be printed when the developer cartridge 32 is a new product, as described above.

The information-detecting mechanism 98 is provided on an inner wall of the main casing 2 near the rear side of the developer cartridge 32 when the developer cartridge 32 is mounted in the main casing 2. The information-detecting mechanism 98 includes a first switch 100, a second switch 101, a first actuator 102 capable of contacting the first switch 100, and a second actuator 103 capable of contacting the second switch 101.

Figure 7:
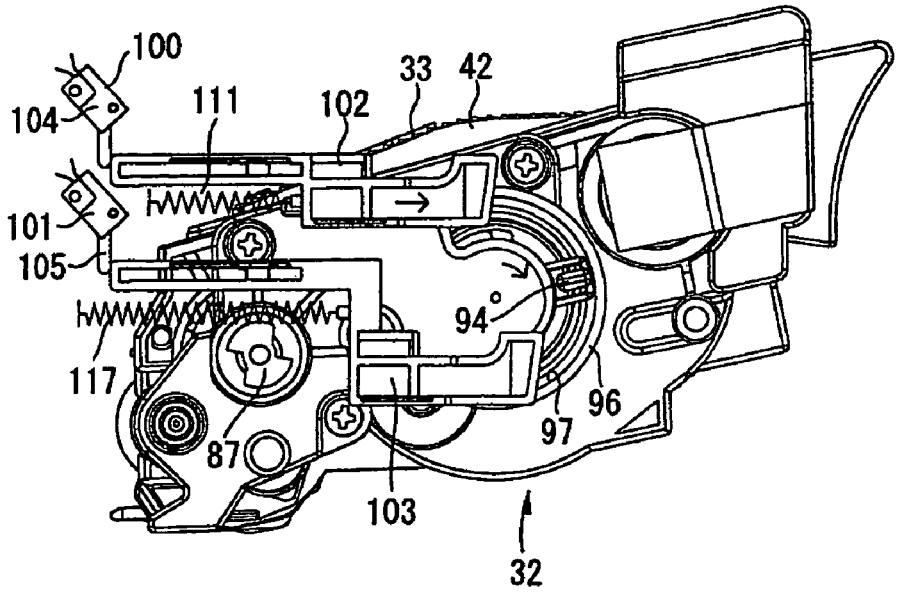
FIG. 7 is an explanatory diagram illustrating a mechanism for detecting a new developer cartridge having the structure shown in FIG. 3.

The first switch 100 is disposed above the developer cartridge 32 and is connected to the CPU 99. The first switch 100 includes a swinging lever 104 having a lower free end that can pivot about an upper base end. The swinging lever 104 normally hangs vertically downward by its own weight, as shown in FIG. 7. When the first actuator 102 moves rearward, the free end of the swinging lever 104 pivots upward. When the free end of the swinging lever 104 is pushed upward in this way (see FIG. 5), the first switch 100 transmits an ON signal (contact signal) to the CPU 99. When the first actuator 102 moves forward, the free end of the swinging lever 104 pivots downward and returns to its normal state shown in FIG. 7. At this time, the first switch 100 transmits an OFF signal (contact removed signal) to the CPU 99.

Figure 13:
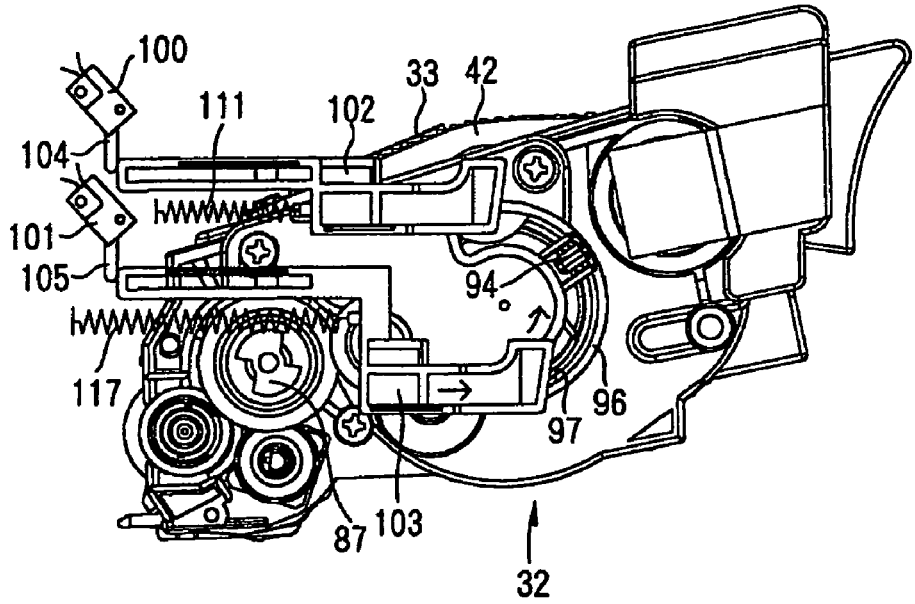
FIG. 13 is an explanatory diagram illustrating a mechanism for detecting a new developer cartridge having the structure shown in FIG. 9.

The second switch 101 is disposed below the first switch 100 and is separated vertically from the first switch 100 by a prescribed distance. The second switch 101 is also connected to the CPU 99 and includes a swinging lever 105. The swinging lever 105 has a lower free end capable of pivoting about an upper base end, but normally hangs vertically downward by its own weight, as shown in FIG. 13. When the second actuator 103 moves rearward, the free end of the swinging lever 105 pivots upward. When the free end of the swinging lever 105 is lifted upward in this way (see FIG. 11), the second switch 101 transmits an ON signal (contact signal) to the CPU 99. When the second actuator 103 moves forward, the free end of the swinging lever 105 pivots downward and returns to its normal position shown in FIG. 13. At this time, the second switch. 101 transmits an OFF signal (contact removed signal) to the CPU 99.

The first actuator 102 is provided above and on the widthwise side of the developer cartridge 32 and is capable of contacting the swinging lever 104 of the first switch 100 from the front side. The first actuator 102 is rod-shaped and extends in the front-to-rear direction. The first actuator 102 is integrally provided with a pressing part 106 on the front side, and a guide part 107 on the rear side.

The pressing part 106 is substantially rectangular in a side view and has a spring receiving part 108 formed in the rear end.

The guide part 107 has a long slender rod shape and extends from the upper rear end of the pressing part 106 rearward. A guide groove 109 is formed in the guide part 107 in the front-to-rear direction. A guiding protrusion 110 that slidably fits into the guide groove 109 is formed on the main casing 2. Hence, the first actuator 102 is attached to the main casing 2 and is capable of sliding in the front-to-rear direction owing to the guide groove 109 fitted in the guiding protrusion 110.

A compression spring 111 is disposed along the front-to-rear direction, with one end fixed to the main casing 2 and another end received in the spring receiving part 108 of the pressing part 106. Accordingly, the urging force of the compression spring 111 constantly urges the first actuator 102 forward to prevent the first actuator 102 from pushing the swinging lever 104 upward.

The second actuator 103 is disposed below the first actuator 102 and is capable of contacting the swinging lever 105 of the second switch 101 from the front side. The second actuator 103 has a rod shape extending in the front-to-rear direction and is integrally provided with a pressing part 112 on the front side, and a guide part 113 on the rear side.

The pressing part 112 is rectangular in shape from a side view. A spring receiving part 114 is formed in the rear end of the pressing part 112.

The guide part 113 is a long slender rod formed substantially like the letter L and extends from the upper rear end of the pressing part 112 rearward. A guiding groove 115 is formed in the guide part 113 in the front-to-rear direction. A guiding protrusion 116 for slidably fitting into the guiding groove 115 is formed on the main casing 2. Hence, the second actuator 103 is attached to the main casing 2 so as to be capable of sliding in the front-to-rear direction owing to the guiding groove 115 fitted in the guiding protrusion 116.

A compression spring 117 is disposed along the front-to-rear direction with one end fixed to the main casing 2 and the other end received in the spring receiving part 114 of the pressing part 112. Accordingly, the urging force of the compression spring 117 constantly urges the second actuator 103 forward. and prevents the second actuator 103 from pushing the swinging lever 105 upward.

3. Operations for Detecting a New Developer Cartridge

Next, a method will be described for determining whether a developer cartridge 32 mounted in the main casing 2 is new or old and for determining the maximum sheets to be printed by the developer cartridge 32.

(a) When the contact protrusion 94 is in the upper position

In this method, the front cover 7 is first opened, and the drum cartridge 31 on which a new developer cartridge 32 is mounted is inserted into the main casing 2 through the access opening 6. Alternatively, the front cover 7 is opened and the new developer cartridge 32 is inserted through the access opening 6 and mounted on the drum cartridge 31 already mounted in the main casing 2.

Figure 6:
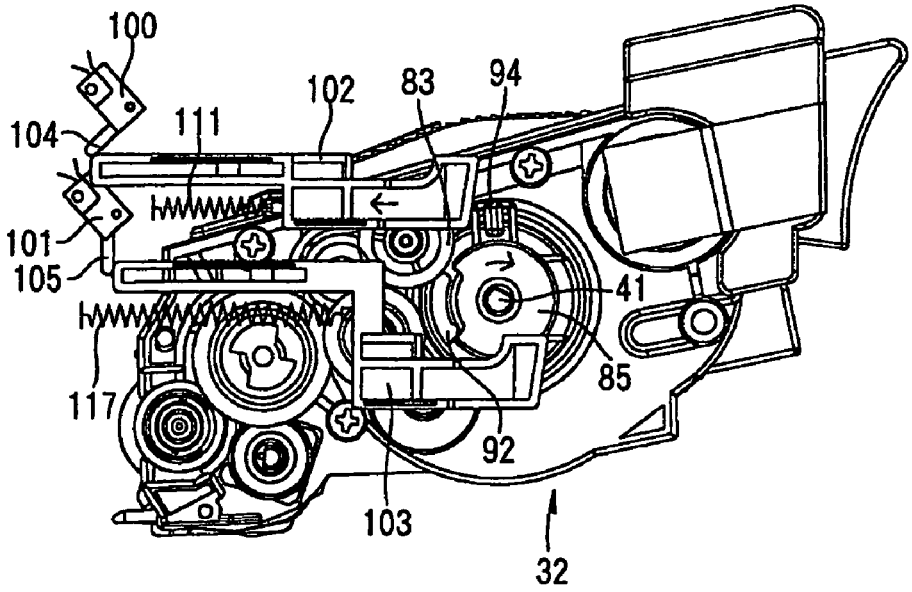
FIG. 6 is an explanatory diagram illustrating a mechanism for detecting a new developer cartridge having the structure shown in FIG. 4.

As shown in FIGS. 5 and 6, the contact protrusion 94 disposed on top of the sensor gear 85 contacts the front end of the first actuator 102 at this time. As a result, the contact protrusion 94 moves slightly from the starting position on the upper side in the direction opposite the mounting direction of the developer cartridge 32 (toward the front side of the main casing 2) to a midway position. Further, the toothed part 92 of the sensor gear 85 moves from a position not engaged with the outer teeth of the third intermediate gear 83 (new product position) to a position engaged with the outer teeth of the third intermediate gear 83 (driving force transferring position).

At this time, contact by the contact protrusion 94 moves the first actuator 102 rearward against the urging force of the compression spring 111. The first actuator 102 pushes against the free end of the swinging lever 104 so that the free end pivots upward. As a result, the first switch 100 transmits an ON signal (contact signal) to the CPU 99. Upon receiving this ON signal from the first switch 100, the CPU 99 determines that the developer cartridge 32 is a new product.

Next, the CPU 99 treats ON signals inputted from the first switch 100 or the second switch 101 as information on the maximum sheets to be printed. More specifically, the CPU 99 determines that the maximum sheets to be printed is 6000 when an ON signal is inputted from the first switch 100 and determines that the maximum sheets to be printed is 3000 when an ON signal is inputted from the second switch 101 by referencing storage means (not shown) storing these correlations.

As described above, when the first switch 100 inputs an ON signal into the CPU 99 for the example shown in FIGS. 5 and 6, the CPU 99 determines that the maximum sheets to be printed with this new developer cartridge 32 is 6000, and subsequently resets a counter.

When the number of sheets detected by the paper discharge sensor 74 as sheets that have actually been printed since the developer cartridge 32 was mounted is about to exceed 6000 sheets, the CPU 99 displays an out of toner warning message on a control panel or the like (not shown).

Further, when the developer cartridge 32 is mounted in the main casing 2, a coupling insertion part (not shown) for transferring a driving force from the motor 75 provided in the main casing 2 is inserted into the coupling receiver part 87 of the input gear 78 in the developer cartridge 32. As a result, the driving force from the motor 75 drives the input gear 78, supply roller drive gear 79, deve1oping roller drive gear 80, first intermediate gear 81, second intermediate gear 82, third intermediate gear 83, agitator drive gear 84, and sensor gear 85 of the gear mechanism 76.

Next, when the developer cartridge 32 is mounted in the main casing 2, the CPU 99 initiates a warmup operation in which an operation is executed to idly rotate the agitator 34.

In this idle rotation operation, the CPU 99 drives the motor 75 provided in the main casing 2. The driving force of the motor 75 is inputted from the coupling insertion part via the coupling receiver part 87 into the input gear 78 in the developer cartridge 32 and drives the input gear 78 to rotate. At this time, the supply roller drive gear 79 engaged with the input gear 78, as shown in FIG. 4, is driven to rotate. The rotation of the supply roller shaft 48 provided in the supply roller drive gear 79 rotates the supply roller 35. Further, the developing roller drive gear 80 engaged with the input gear 78 is also driven to rotate, and the rotation of the developing roller shaft 50 provided in the developing roller drive gear 80 rotates the developing roller 36. Further, the first intermediate gear 81 whose outer teeth are engaged with the input gear 78 is driven to rotate, while the second intermediate gear 82 engaged with the inner teeth of the first intermediate gear 81 is driven to rotate. Further, the third intermediate gear 83 whose inner teeth are engaged with the second intermediate gear 82 is driven to rotate, while the agitator drive gear 84 engaged with the inner teeth of the third intermediate gear 83 is also driven to rotate. When the agitator drive gear 84 rotates, the rotation of the rotational shaft 41 provided in the agitator drive gear 84 rotates the agitator 34. The rotation of the agitator 34 stirs the toner in the toner-accommodating chamber 39 and generates a flow of toner.

Figure 8:
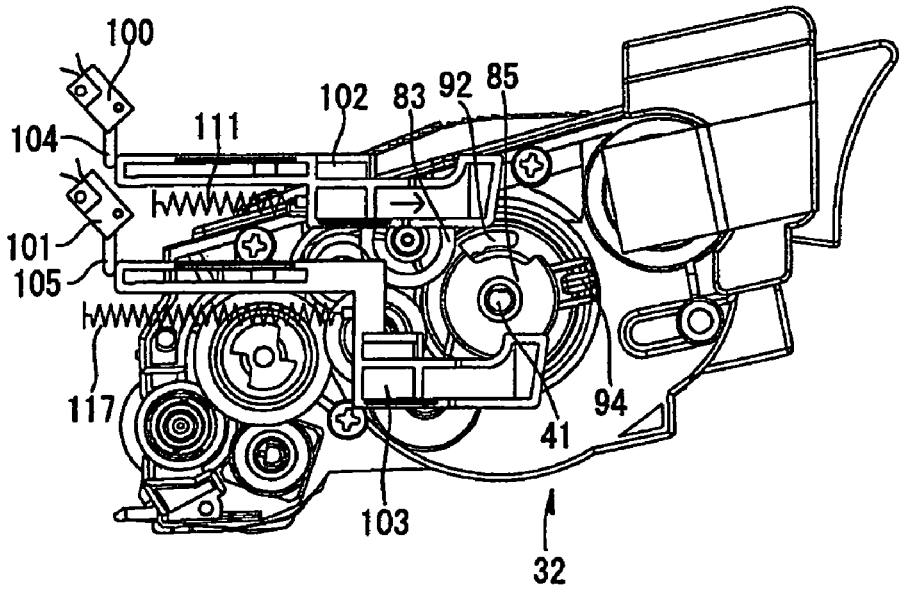
FIG. 8 is an explanatory diagram illustrating a mechanism for detecting a new developer cartridge having the structure shown in FIG. 4.

When the third intermediate gear 83 is driven to rotate in the idle rotation operation, as shown in FIGS. 7 and 8, the sensor gear 85 having a toothed part 92 engaged with the outer teeth of the third intermediate gear 83 is driven to rotate irreversibly in the clockwise direction about one-fourth of a rotation around the rotational shaft 41 from the upstream end to a downstream end in the direction of movement. Subsequently, the outer teeth of the third intermediate gear 83 disengage from the toothed part 92 of the sensor gear 85, halting the sensor gear 85 in a disengaged position (old product position).

As the sensor gear 85 is driven to rotate, the contact protrusion 94 integrally provided on the sensor gear 85 moves along the sensing window 97 of the sensor gear cover 96 irreversibly in the clockwise direction while describing an arc-shaped path from a starting position on the upper rear side of the sensing window 97 toward an ending position on the front side. At this time, the urging force of the compression spring 111 moves the first actuator 102 forward, allowing the swinging lever 104 of the first switch 100 to hang downward and prompting the first switch 100 to transmit an OFF signal (contact removed signal) to the CPU 99. Upon receiving this OFF signal from the first switch 100, the CPU 99 determines that the developer cartridge 32 is not a new product and increments the counter each time image formation is performed on a sheet until the first switch 100 inputs an ON signal.

After the toothed part 92 of the sensor gear 85 disengages from the outer teeth of the third intermediate gear 83 and the sensor gear 85 is halted in the old product position, the sensor gear 85 is maintained in this old product position by the contact resistance between the contact protrusion 94 and the sensing window 97 of the sensor gear cover 96. Further, the sensor gear 85 slides over the rotational shaft 41 when in the old product position, allowing the rotational shaft 41 to be driven to rotate.

Even if the developer cartridge 32 mounted in the main casing 2 as a new product is subsequently removed from the main casing 2 due to a paper jam or the like, and. then the developer cartridge 32 is remounted in the main casing 2, the sensor gear 85 is maintained in a halted state in the old product position. Accordingly, the contact protrusion 94 of the sensor gear 85 does not contact the front end of the first actuator 102 when remounting the developer cartridge 32 and therefore the first switch 100 does not input an ON signal to the CPU 99. Accordingly, the CPU 99 does not mistake the remounted developer cartridge 32 as a new product, but continues to compare the number of sheets 3 on which images have actually been formed based on the counter reset when the developer cartridge 32 is determined to be new. The CPU 99 determines that the developer cartridge 32 has reached the end of its life just before the number of sheets on which images have actually been formed based on the counter approaches the maximum sheets to be printed, as described above.

(b) When the contact protrusion 94 is in the lower position

In this method, the front cover 7 is first opened, and the drum cartridge 31 on which a new developer cartridge 32 is mounted is inserted into the main casing 2 through the access opening 6. Alternatively, the front cover 7 is opened and the new developer cartridge 32 is inserted through the access opening 6 and mounted on the drum cartridge 31 already mounted in the main casing 2.

Figure 11:
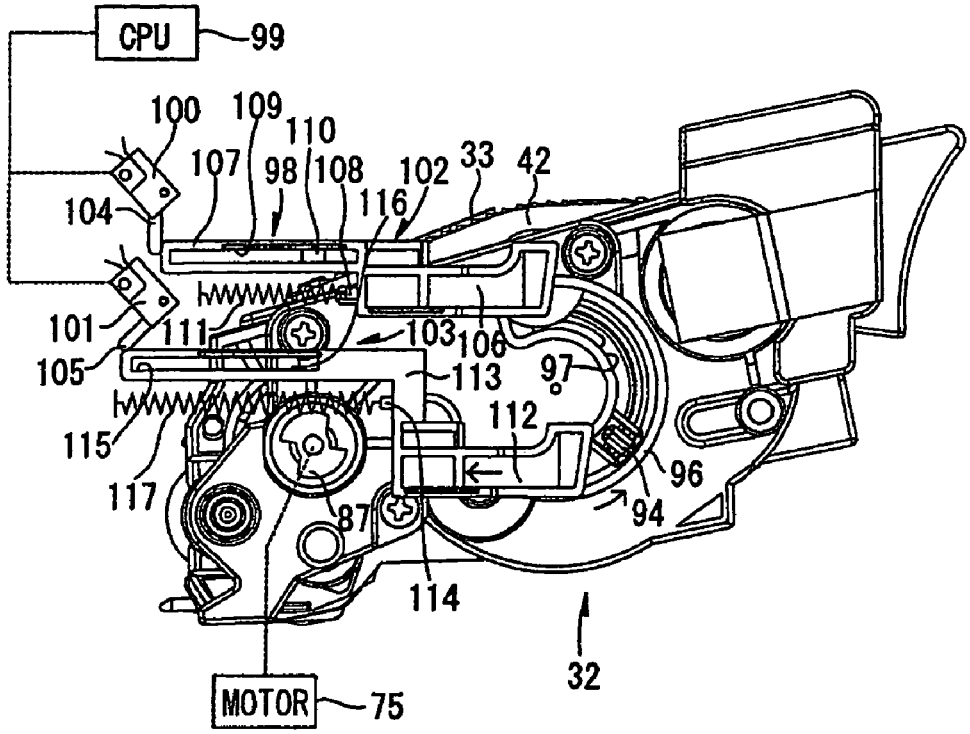
FIG. 11 is an explanatory diagram illustrating a mechanism for detecting a new developer cartridge having the structure shown in FIG. 9.
Figure 12:
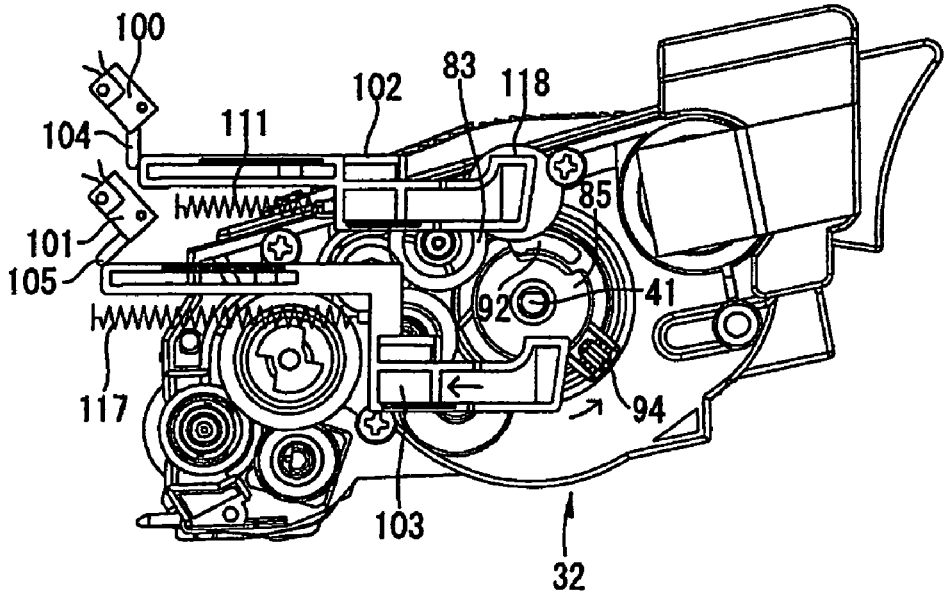
FIG. 12 is an explanatory diagram illustrating a mechanism for detecting a new developer cartridge having the structure shown in FIG. 10.

As shown in FIGS. 11 and 12, the contact protrusion 94 disposed on top of the sensor gear 85 contacts the front end of the second actuator 103 at this time. As a result, the contact protrusion 94 moves slightly from the starting position on the lower side in the direction opposite the mounting direction of the developer cartridge 32 (toward the front side of the main casing 2) to a midway position. Further, the toothed part 92 of the sensor gear 85 moves from a position not engaged with the fourth intermediate gear 118 (new product position) to a position engaged with the fourth intermediate gear 118 (driving force transferring position).

At this time, contact by the contact protrusion 94 moves the second actuator 103 rearward against the urging force of the compression spring 117. The second actuator 103 pushes against the free end of the swinging lever 105 so that the free end pivots upward. As a result, the second switch 101 transmits an ON signal (contact signal) to the CPU 99. Upon receiving this ON signal from the second switch 101, the CPU 99 determines that the developer cartridge 32 is a new product.

Next, the CPU 99 treats ON signals inputted from the first switch 100 or the second switch 101 as information on the maximum sheets to be printed. As described above, when the second switch 101 inputs an ON signal into the CPU 99 for the example shown in FIGS. 11 and 12, the CPU 99 determines that the maximum sheets to be printed with this new developer cartridge 32 is 3000, and subsequently resets a counter.

As a result, when the developer cartridge 32 is mounted for the example shown in FIGS. 11 and 12, the CPU 99 determines that the developer cartridge 32 is new and that the maximum sheets to be printed with the developer cartridge 32 is 3000. When the number of sheets detected by the paper discharge sensor 74 as sheets that have actually been printed since the developer cartridge 32 was mounted is about to exceed 3000 sheets, the CPU 99 displays an out of toner warning message on a control panel or the like (not shown).

Further, when the developer cartridge 32 is mounted in the main casing 2, a coupling insertion part (not shown) for transferring a driving force from the motor 75 provided in the main casing 2 is inserted into the coupling receiver part 87 of the input gear 78 in the developer cartridge 32. As a result, the driving force from the motor 75 drives the input gear 78, supply roller drive gear 79, developing roller drive gear 80, first intermediate gear 81, second intermediate gear 82, third intermediate gear 83, agitator drive gear 84, fourth intermediate gear 118, and sensor gear 85 of the gear mechanism 76.

Next, when the developer cartridge 32 is mounted in the main casing 2, the CPU 99 initiates a warmup operation in which an operation is executed to idly rotate the agitator 34, as described above.

In this idle rotation operation, as described above, the CPU 99 drives the motor 75 provided in the main casing 2. The driving force of the motor 75 is inputted from the coupling insertion part via the coupling receiver part 87 into the input gear 78 in the developer cartridge 32 and drives the input gear 78 to rotate. As in the process described above, the input gear 78 transfers a driving force to the supply roller drive gear 79, developing roller drive gear 80, first intermediate gear 81, second intermediate gear 82, third intermediate gear 83, and agitator drive gear 84, as shown in FIG. 10. The driving force drives the supply roller 35, developing roller 36, and agitator 34 to rotate. The rotation of the agitator 34 stirs the toner in the toner-accommodating chamber 39 and generates a flow of toner.

Figure 14:
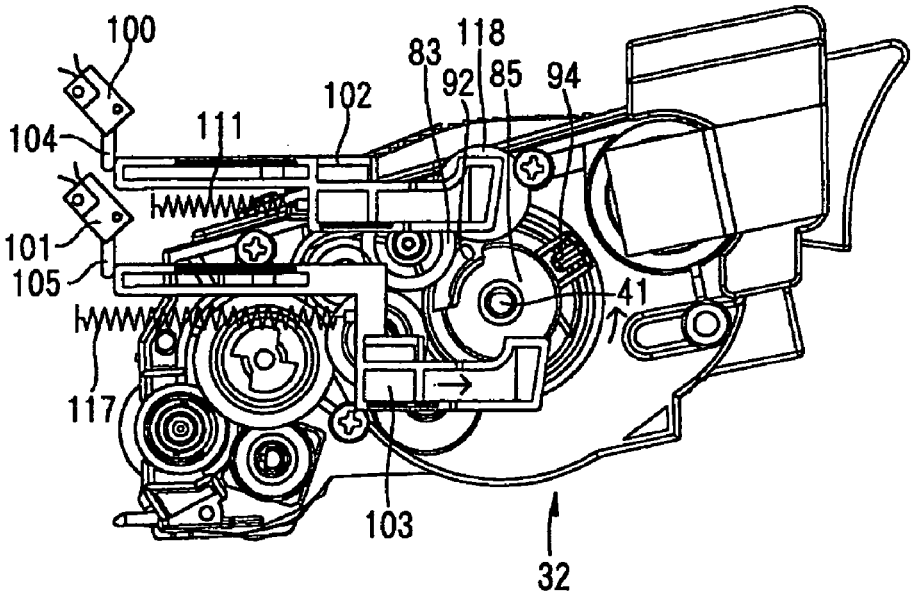
FIG. 14 is an explanatory diagram illustrating a mechanism for detecting a new developer cartridge having the structure shown in FIG. 10.

When the third intermediate gear 83 is driven to rotate in the idle rotation operation, the fourth intermediate gear 118 engaged with the outer teeth of the third intermediate gear 83 is driven to rotate. When the fourth intermediate gear 118 rotates, as shown in FIGS. 13 and 14, the sensor gear 85 having the toothed part 92 engaged with the fourth intermediate gear 118 is driven to rotate irreversibly in the counterclockwise direction about one-fourth of a rotation around the rotational shaft 41 from the upstream end to the downstream end in the direction of movement. Subsequently, the fourth intermediate gear 118 disengages from the toothed part 92, halting the sensor gear 85 in a disengaged position (old product position).

As the sensor gear 85 is driven to rotate, the contact protrusion 94 integrally provided on the sensor gear 85 moves along the sensing window 97 of the sensor gear cover 96 irreversibly in the counterclockwise direction while describing an arc-shaped path from a midway position on the lower rear side of the sensing window 97 toward an ending position located diagonally upward and forward.

At this time, the urging force of the compression spring 117 moves the second actuator 103 forward, allowing the swinging lever 105 of the second switch 101 to hang downward and prompting the second switch 101 to transmit an OFF signal (contact removed signal) to the CPU 99. Upon receiving this OFF signal from the second switch 101, the CPU 99 determines that the developer cartridge 32 is not a new product and increments the counter each time image formation is performed on a sheet until the second switch 101 inputs an ON signal.

After the toothed part 92 of the sensor gear 85 disengages from the fourth intermediate gear 118 and the sensor gear 85 is halted in the old product position, the sensor gear 85 is maintained in this old product position by the contact resistance between the contact protrusion 94 and the sensing window 97 of the sensor gear cover 96. Further, the sensor gear 85 slides over the rotational shaft 41 when in the old product position, allowing the rotational shaft 41 to be driven to rotate.

Even if the developer cartridge 32 mounted in the main casing 2 as a new product is subsequently removed from the main casing 2 due to a paper jam or the like, and then the developer cartridge 32 is remounted in the main casing 2, the sensor gear 85 is maintained in a halted state in the old product position. Accordingly, the contact protrusion 94 of the sensor gear 85 does not contact the front end of the second actuator 103 when remounting the developer cartridge 32 and therefore the second switch 101 does not input an ON signal to the CPU 99. Accordingly, the CPU 99 does not mistake the remounted developer cartridge 32 as a new product, but continues to compare the number of sheets 3 on which images have actually been formed based on the counter reset when the developer cartridge 32 is determined to be new. The CPU 99 determines that the developer cartridge 32 has reached the end of its life just before the number of sheets on which images have actually been formed based on the counter approaches the maximum sheets to be printed, as described above.

4. Effects of the Method for Detecting a New Developer Cartridge

With the laser printer 1 described above, the contact protrusion 94 is selectively disposed in the upper position or lower position in the developer cartridge 32. Accordingly, the first actuator 102 and first switch 100 or the second actuator 103 and second switch 101 detect the existence of the contact protrusion 94 in the upper or lower position when the developer cartridge 32 is mounted in the main casing 2, enabling the CPU 99 to determine whether the mounted developer cartridge 32 is new.

In the idle rotation operation the contact protrusion 94 moves from a starting position to an ending position, but in opposite directions when the contact protrusion 94 is disposed in the upper position and when the contact protrusion 94 is disposed in the lower position. Specifically, when disposed on the upper side, the contact protrusion 94 moves irreversibly in a clockwise direction from the upper rear side toward the front side. However, when disposed in the lower side, the contact protrusion 94 moves irreversibly in a counterclockwise direction from the lower rear side to a position diagonally upward and toward the front. This construction can prevent incorrect detections with the first actuator 102 and first switch 100 or the second actuator 103 and second switch 101.

The sensor gear 85 is configured of a toothless gear and is driven to rotate while a driving force from the motor 75 is transferred to the toothed part 92 of the sensor gear 85. However, rotation of the sensor gear 85 is halted when the driving force is no longer transferred to the sensor gear 85 at the toothless part 93. Accordingly, the sensor gear 85 can reliably be driven a prescribed drive amount from the beginning of rotation to the end of rotation. As the sensor gear 85 is driven to rotate, the contact protrusion 94 can reliably and irreversibly be moved from a starting position to an ending position.

Since the contact protrusion 94 is integrally provided on the sensor gear 85, the contact protrusion 94 can be more reliably moved together with the rotation of the sensor gear 85.

When the contact protrusion 94 is disposed in the upper position of the developer cartridge 32, four gears are used in the gear mechanism 76 from the input gear 78 to the third intermediate gear 83 that transfers the driving force to the sensor gear 85. These gears include the input gear 78, first intermediate gear 81, second intermediate gear 82, and third intermediate gear 83. When the contact protrusion 94 is disposed in the lower position, five gears are used in the gear mechanism 76 from the input gear 78 to the fourth intermediate gear 118 that transfers the driving force to the sensor gear 85. These five gears are the input gear 78, first intermediate gear 81, second. intermediate gear 82, third intermediate gear 83, and fourth intermediate gear 118.

Hence, the difference in the number of gears used to transfer a driving force to the sensor gear 85 when the contact protrusion 94 is disposed in the upper position and when the contact protrusion 94 is disposed in the lower position is an odd number (one gear). Hence, the sensor gear 85 can reliably be driven in opposite directions when the contact protrusion 94 is disposed in the upper position and when the contact protrusion 94 is disposed in the lower position, thereby reliably moving the contact protrusion 94 in opposite directions when the contact protrusion 94 is disposed in the upper position and when the contact protrusion 94 is disposed in the lower position.

The contact protrusion 94 disposed in the upper position of the developer cartridge 32 and the contact protrusion 94 disposed in the lower position of the developer cartridge 32 are positioned relative to one another such that a first distance from the axial center of the rotational shaft 41 to the contact protrusion 94 in the upper position is essentially the same as a second distance from the axial center of the rotational shaft 41 to the contact protrusion 94 disposed in the lower position. Accordingly, the sensing window 97 of the sensor gear cover 96 can be formed as a continuous path enabling the contact protrusion 94 to move in a circumferential path whether the contact protrusion 94 is initially disposed in the upper position or in the lower position. This construction can simplify the design of the device.

Further, the relative positions of the contact protrusion 94 disposed on the upper side of the developer cartridge 32 and the contact protrusion 94 disposed on the lower side of the developer cartridge 32 are such that a line segment connecting the contact protrusion 94 disposed in the upper side to the axial center of the rotational shaft 41 forms an obtuse angle with a line segment connecting the contact protrusion 94 disposed in the lower side to the axial center of the rotational shaft 41. Even more, the upper position and the lower position are set such that a line segment connecting the upper position and the lower position passes over the rotational shaft 41. Hence, the gap between the contact protrusion 94 disposed on the upper side and the contact protrusion 94 disposed on the lower side can be widened to reliably prevent incorrect detections by the first actuator 102 and first switch 100 and by the second actuator 103 and second switch 101.

Further, the contact protrusion 94 is selectively disposed on the upper side or lower side of the developer cartridge 32, and information regarding the maximum sheets to be printed with the developer cartridge 32 is set according to the relative position of the contact protrusion 94. Hence, the CPU 99 in the laser printer 1 of the preferred embodiment can easily and reliably determine information for the maximum sheets to be printed with the developer cartridge 32 based on an ON signal inputted from the first switch 100 or the second switch 101. Therefore, the laser printer 1 can reliably determine the life of the developer cartridge 32 to ensure that the developer cartridge 32 is replaced at a more precise time regardless of the amount of toner in the developer cartridges 32 corresponding to the maximum sheets to be printed.

Since the CPU 99 in the laser printer 1 of the preferred embodiment can determine whether the mounted developer cartridge 32 is new based on whether the first switch 100 or the second switch 101 detects the contact protrusion 94 in the mounted developer cartridge 32, the laser printer 1 of the preferred embodiment can easily and reliably determine whether the developer cartridge 32 is old or new. Accordingly, the laser printer 1 can reliably determine when the developer cartridge 32 reaches the end of its life from the point that the developer cartridge 32 was determined to be new.

5. First Variation

Though the contact protrusions are disposed at the upper position and at the lower position in the preferred embodiment, the contact protrusions are disposed at the rear side in the upper position and at the front side in the upper position in the first variation.

Figure 19:
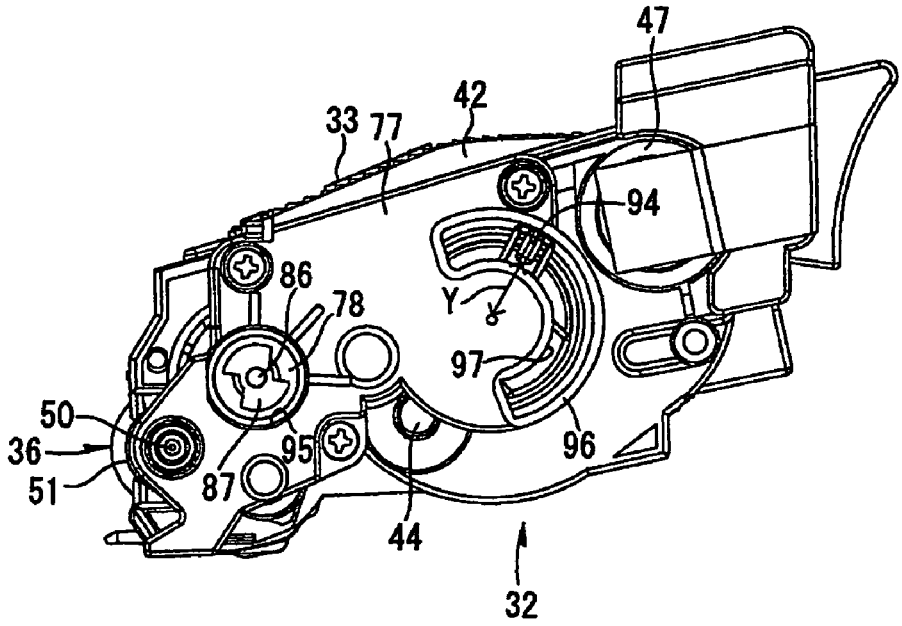
FIG. 19 is a side view of the developer cartridge in FIG. 2 according to the first variation of the embodiment when the contact protrusion is disposed on the front side and the gear cover is mounted.
Figure 20:
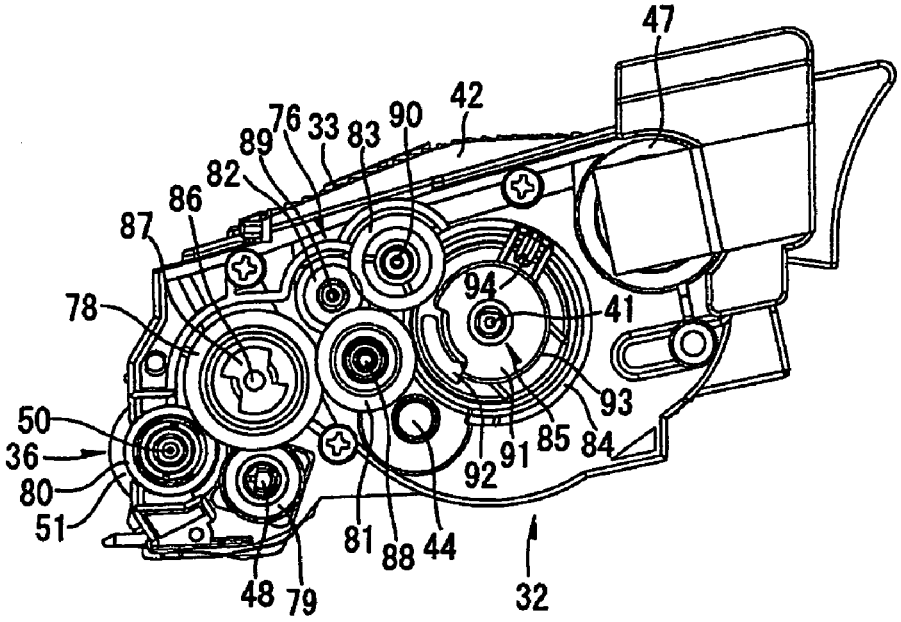
FIG. 20 is a side view of the developer cartridge in FIG. 2 according to the first variation of the embodiment when the contact protrusion is disposed on the front side and the gear cover has been removed.

FIGS. 15 through 18 are explanatory diagrams illustrating a mechanism for detecting a new developer cartridge in the first variation. FIG. 19 is a side view of the developer cartridge when the contact protrusion is disposed on the front side and the gear cover is mounted. FIG. 20. is a side view of the developer cartridge when the contact protrusion is disposed on the front side and the gear cover has been removed. FIGS. 21 through 24 are explanatory diagrams illustrating a mechanism for detecting a new developer cartridge having the structure shown in FIGS. 19 and 20. The following description of the first variation does not repeat a description of identical structures in the first embodiment, but only describes the structure that differs from that of the first embodiment.

(a) Structure of the developer cartridge

In the first variation of the preferred embodiment, the contact protrusion 94 is selectively disposed in a position in the front-to-rear direction along the periphery of the sensor gear 85.

More specifically, the developer cartridge 32 of the first variation has a similar structure to the developer cartridge 32 shown in FIGS. 3 and 4 when the starting position of the contact protrusion 94 is a first position on the rear side.

However, when the starting position of the contact protrusion 94 is forward in a second position, the developer cartridge 32 includes the gear mechanism 76 having the same structure as that in the developer cartridge 32 shown in FIGS. 3 and 4 (in other words, the gear mechanism 76 does not include the fourth intermediate gear 118, and the outer teeth of the third intermediate gear 83 engage with the toothed part 92 of the sensor gear 85). However, in the sensor gear 85 shown in FIGS. 19 and 20, the contact protrusion 94 is positioned further forward and separated from the contact protrusion 94 in the developer cartridge 32 shown in FIGS. 3 and 4.

More specifically, the contact protrusion 94 disposed in the rearward position shown in FIG. 3 and the contact protrusion 94 disposed in the forward position shown in FIG. 19 are positioned relative to each other such that a first distance from the axial center of the rotational shaft 41 to the contact protrusion 94 disposed in the rearward position (indicated by X in FIG. 3) is essentially the same as a second distance from the axial center of the rotational shaft 41 to the contact protrusion 94 disposed in the forward position (indicated by Y in FIG. 19). Further, a line segment connecting the contact protrusion 94 in the rearward position to the axial center of the rotational shaft 41 forms an acute angle with a line segment connecting the contact protrusion 94 disposed in the forward position to the axial center of the rotational shaft 41. Hence, the toothed part 92 moves in the same direction along the same path whether disposed in the rearward position or the forward position. The toothed part 92 when in the forward position is disposed at a slightly lower position than the toothed part 92 when in the rearward position.

When in the rearward position shown in FIGS. 3 and 4, the contact protrusion 94 corresponds to information indicating that the maximum sheets to be printed is 6000. When in the forward position shown in FIGS. 19 and 20, the contact protrusion 94 corresponds to information indicating that the maximum sheets to be printed is 3000.

(b) Structure of the main casing

Figure 21:
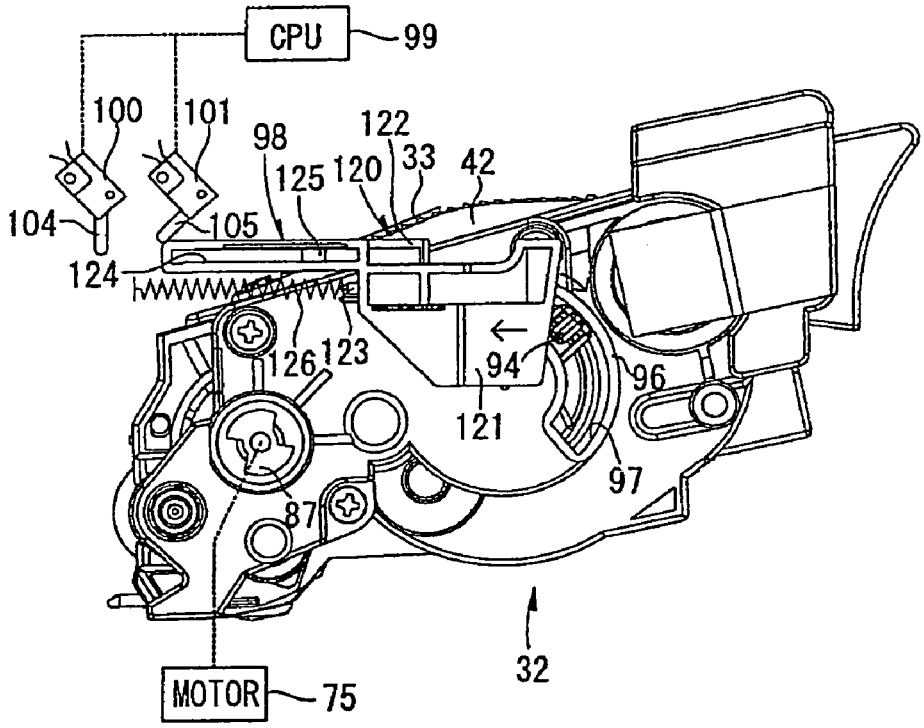
FIG. 21 is an explanatory diagram illustrating a mechanism according to the first variation of the embodiment for detecting a new developer cartridge having the structure shown in FIG. 19.

As shown in FIG. 21, the information-detecting mechanism 98 in the first variation of the preferred embodiment includes the first switch 100, the second switch 101, and a third actuator 120 capable of contacting the first switch 100 and the second switch 101.

The first switch 100 and second switch 101 are constructed identical to those described in the preferred embodiment. However, in the present variation, both the first switch 100 and the second switch 101 are disposed above the developer cartridge 32 and are separated by a prescribed distance in the front-to-rear direction with the first switch 100 disposed rearward of the second switch 101.

The third actuator 120 is disposed on the side of the developer cartridge 32 and is capable of contacting both the swinging lever 105 of the second switch 101 and the swinging lever 104 of the first switch 100 from the front sides thereof. The third actuator 120 is rod-shaped and extends in the front-to-rear direction. The third actuator 120 is integrally provided with a pressing part 121 disposed on the front side, and a guide part 122 disposed on the rear side.

The pressing part 121 is substantially rectangular in shape in a side view and is longer vertically than the pressing part 106 of the first actuator 102 and the pressing part 112 of the second actuator 103 described above. As a result, the pressing part 121 can contact both the contact protrusion 94 disposed in the forward position and the contact protrusion 94 disposed in the rearward position. A spring receiving part 123 is formed in the rear end of the pressing part 121.

The guide part 122 has a long slender. rod shape and extends rearward from the upper rear end of the pressing part 121. A guiding groove 124 extending in the front-to-rear direction is formed in the guide part 122. A guiding protrusion 125 for slidably fitting into the guiding groove 124 is formed on the main casing 2. Hence, the third actuator 120 is attached to the main casing 2 and is capable of sliding in the front-to-rear direction owing to the guiding protrusion 125 fitted into the guiding groove 124.

Figure 23:
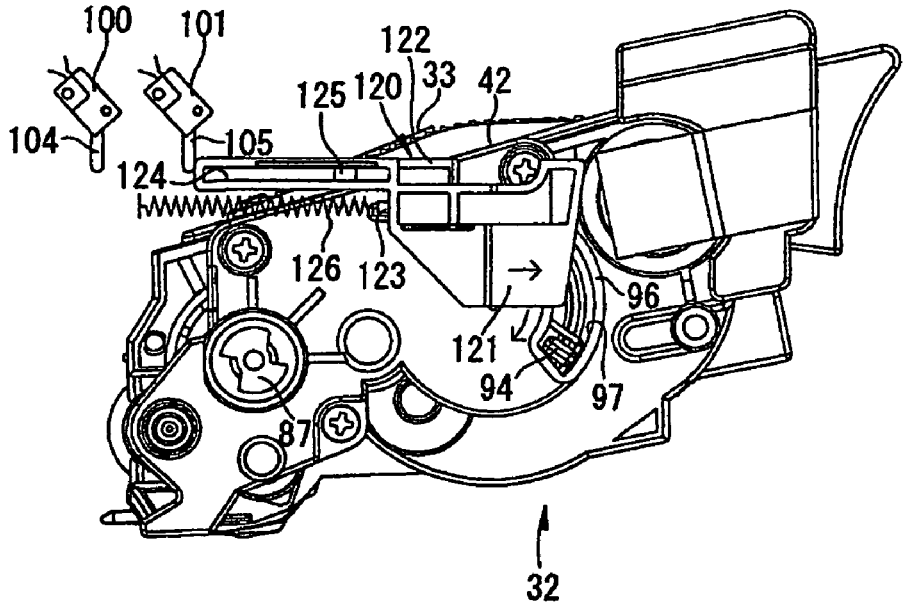
FIG. 23 is an explanatory diagram illustrating a mechanism according to the first variation of the embodiment for detecting a new developer cartridge having the structure shown in FIG. 19.

A compression spring 126 is disposed in the front-to-rear direction, with one end fixed to the main casing 2 and the other end received in the spring receiving part 123 of the pressing part 121. The urging force of the compression spring 126 constantly urges the third actuator 120 forward so that the swinging lever 105 of the second switch 101 is in contact with the rear end of the third actuator 120 in the front-to-rear direction, as shown in FIG. 23.

(c) Operations for detecting a new developer cartridge

Next, a method will be described for determining whether a developer cartridge 32 mounted in the main casing 2 is old or new and for determining the maximum sheets to be printed by this developer cartridge 32.

(c-1) When the contact protrusion is disposed in the rearward position

Figure 15:
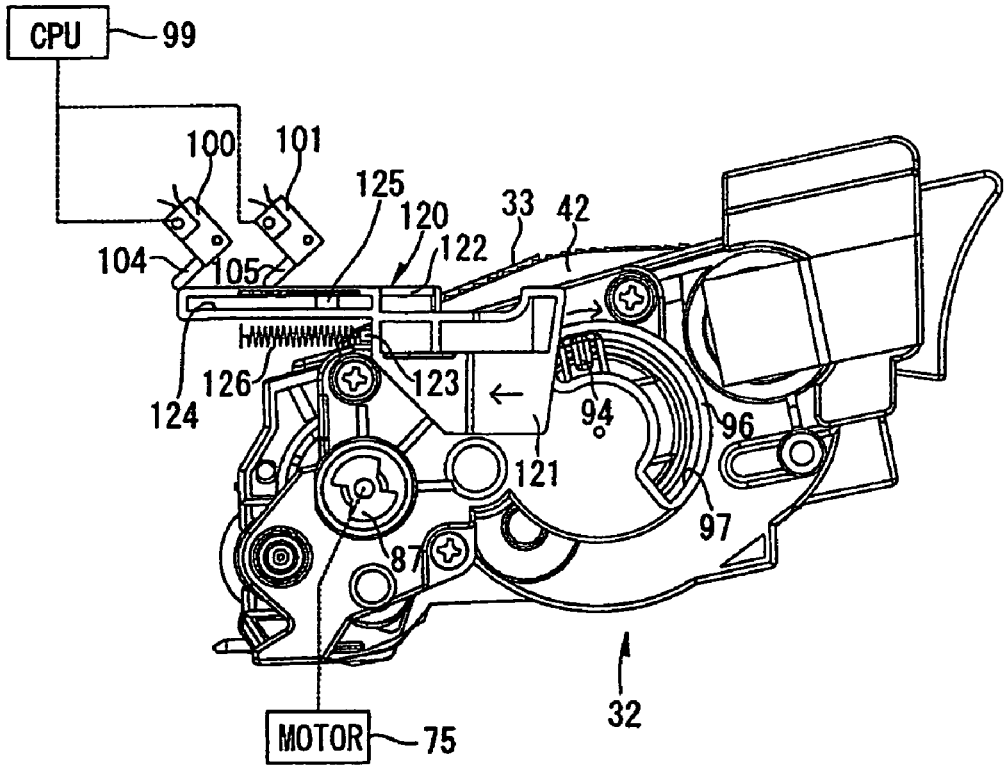
FIG. 15 is an explanatory diagram illustrating a mechanism according to a first variation of the embodiment for detecting a new developer cartridge having the structure shown in FIG. 3.
Figure 16:
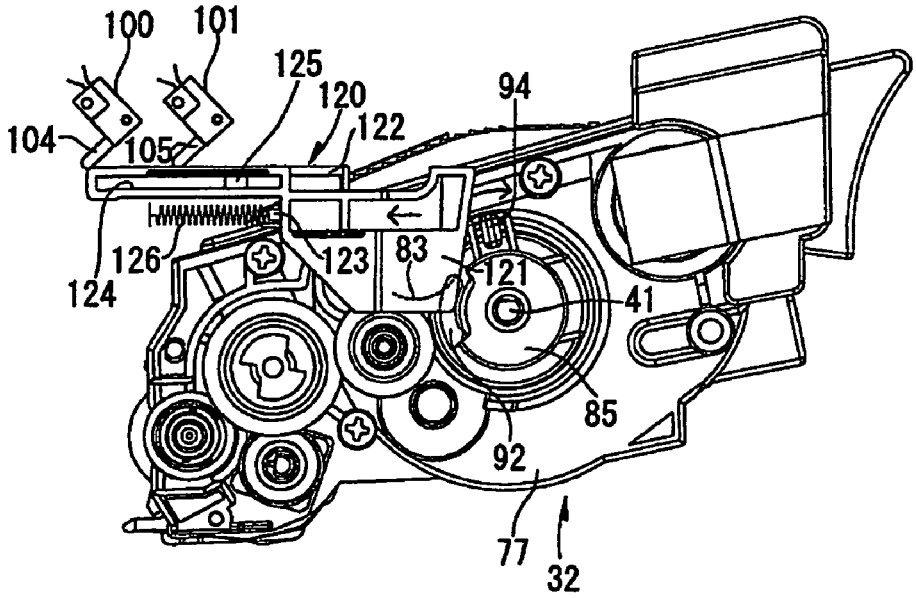
FIG. 16 is an explanatory diagram illustrating a mechanism according to the first variation of the embodiment for detecting a new developer cartridge having the structure shown in FIG. 4.

When a new developer cartridge 32 is mounted in the main casing 2, the contact protrusion 94 disposed in the rearward position contacts the front end of the third actuator 120, as shown in FIGS. 15 and 16. At this time, the contact protrusion 94 moves slightly from this starting position on the rearward side in a direction opposite the mounting direction of the developer cartridge 32 (toward the front of the main casing 2). Further, the toothed part 92 of the sensor gear 85 moves from a position not engaged with the outer teeth of the third intermediate gear 83 (new product position) to a position engaged with the outer teeth of the third intermediate gear 83 (driving force transfer position).

At this time, contact with the contact protrusion 94 moves the third actuator 120 rearward against the urging force of the compression spring 126. The third actuator 120 pushes the free end of the swinging lever 105, causing the free end of the swinging lever 105 to pivot upward, and continues under the swinging lever 105 to contact the swinging lever 104 of the first switch 100, causing the free end of the swinging lever 104 to pivot upward. As a result, both the second switch 101 and the first switch 100 transmit ON signals (contact signals) to the CPU 99.

Upon receiving an ON signal from the second switch 101, the CPU 99 determines that the developer cartridge 32 is a new product.

Further, the CPU 99 associates ON signals inputted from the second switch 101 and the first switch 100 with information on the maximum sheets to be printed. Specifically, when ON signals are inputted from both the second switch 101 and the first switch 100, for example, the CPU 99 determines that the maximum sheets to be printed is 6000. When an ON signal is inputted from only the second switch 101, the CPU 99 determines that the maximum sheets-to be printed is 3000.

As described above, when ON signals are inputted into the CPU 99 from both the second switch 101 and first switch 100, as in the example shown in FIGS. 15 and 16, the CPU 99 determines that the developer cartridge 32 is a new product and that the maximum sheets to be printed with the developer cartridge 32 is 6000. At this time, the CPU 99 resets the counter.

Hence, in the example shown in FIGS. 15 and 16, the CPU 99 determines that the developer cartridge 32 mounted in the main casing 2 is a new product and that the maximum sheets to be printed with the developer cartridge 32 is 6000 sheets. When the actual number of sheets detected by the paper discharge sensor 74 as having been printed since the developer cartridge 32 was mounted approaches 6000 sheets, the CPU 99 displays an out-of-toner message in a control panel or the like (not shown).

Further, when the developer cartridge 32 is mounted in the main casing 2, the sensor gear 85 can be driven to rotate, as described in the preferred embodiment. Hence, the sensor gear 85 is driven to rotate in an idle rotation operation.

Figure 17:
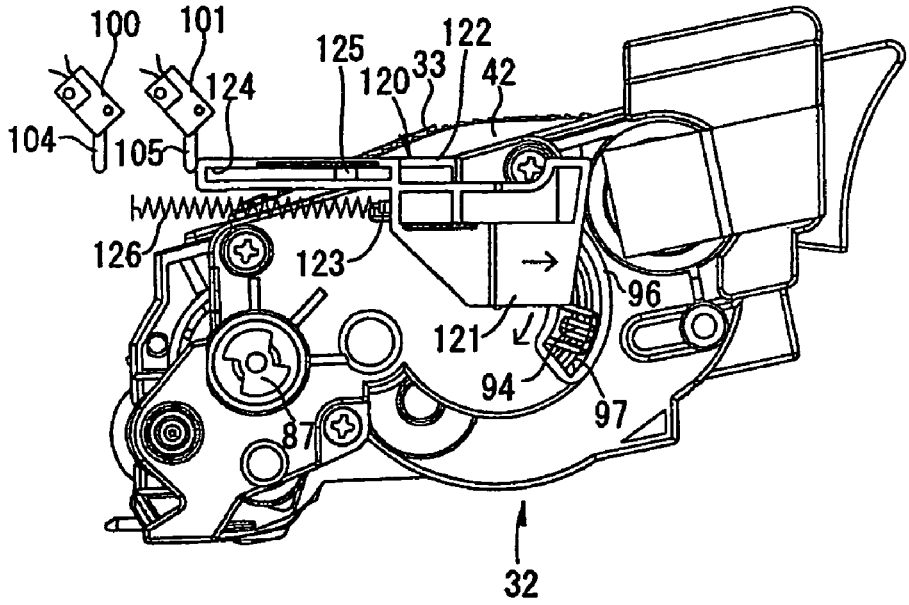
FIG. 17 is an explanatory diagram illustrating a mechanism according to the first variation of the embodiment for detecting a new developer cartridge having the structure shown in FIG. 3.
Figure 18:
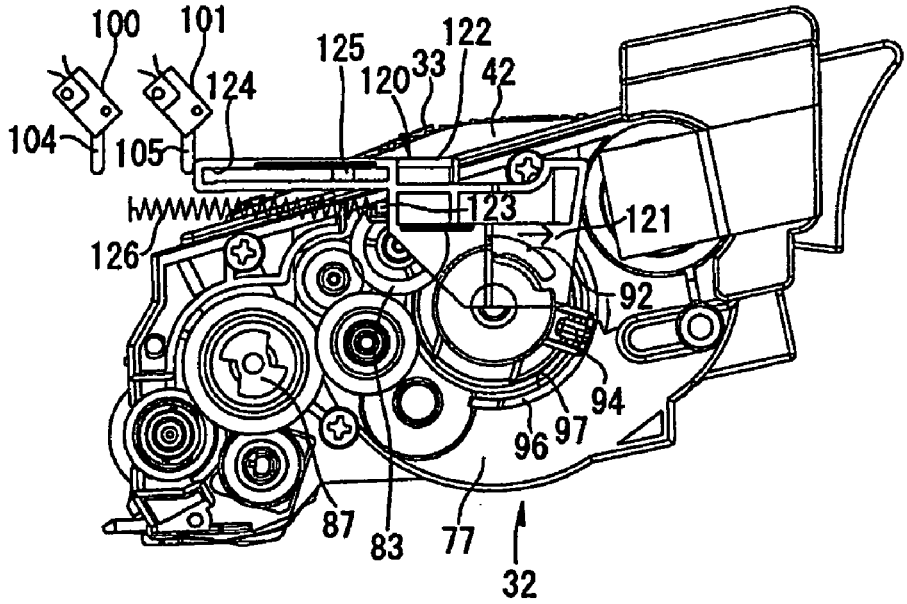
FIG. 18 is an explanatory diagram illustrating a mechanism according to the first variation of the embodiment for detecting a new developer cartridge having the structure shown in FIG. 4.

In the idle rotation operation, as shown in FIGS. 17 and 18, the sensor gear 85 is driven to rotate irreversibly in the clockwise direction about one-fourth of a rotation around the rotational shaft 41 from the upstream end to the downstream end in the direction of movement. Subsequently, the outer teeth of the third intermediate gear 83 disengage from the toothed part 92 of the sensor gear 85, and the third actuator 120 pushes the contact protrusion 94 to rotate, halting the contact protrusion 94 in a rotational position (old product position).

As the sensor gear 85 is driven to rotate, the contact protrusion 94 integrally provided on the sensor gear 85 moves along the sensing window 97 of the sensor gear cover 96 irreversibly in the clockwise direction while describing an arc-shaped path from a midway position on the upper rear side of the sensing window 97 toward an ending position located diagonally forward and downward.

At this time, the urging force of the compression spring 126 moves the third actuator 120 forward, allowing the swinging lever 104 of the first switch 100 to hang downward and subsequently allowing the swinging lever 105 of the second switch 101 to hang downward and prompting the first switch 100 and second switch 101 to transmit OFF signals (contact removed signal) to the CPU 99. Upon receiving an OFF signal from the second switch 101, the CPU 99 determines that the developer cartridge 32 is not a new product and increments the counter each time image formation is performed on a sheet until the second switch 101 inputs an ON signal.

Even if the developer cartridge 32 is mounted in the main casing 2 as a new product and is subsequently removed from the main casing 2 due to a paper jam or the like, the sensor gear 85 is maintained in a halted state in the old product position when the developer cartridge 32 is remounted in the main casing 2. Accordingly, the contact protrusion 94 of the sensor gear 85 does not contact the front end of the third actuator 120 when remounting the developer cartridge 32 and therefore the second switch 101 does not input an ON signal to the CPU 99. Accordingly, the CPU 99 does not mistake the remounted developer cartridge 32 as a new product, but continues to compare the number of sheets 3 on which images have actually been formed based on the counter reset when the developer cartridge 32 is determined to be new. The CPU 99 determines that the developer cartridge 32 has reached the end of its life just before the number of sheets on which images have actually been formed based on the counter approaches the maximum sheets to be printed, as described above.

(c-2) When the contact protrusion is disposed in the forward position

Figure 22:
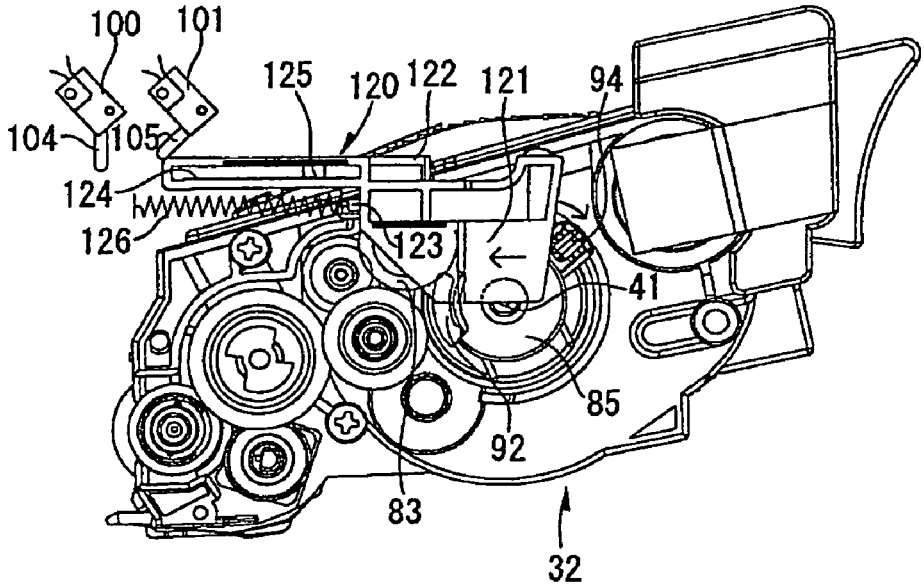
FIG. 22 is an explanatory diagram illustrating a mechanism according to the first variation of the embodiment for detecting a new developer cartridge having the structure shown in FIG. 20.

When a new developer cartridge 32 is mounted in the main casing 2, the contact protrusion 94 disposed in the rearward position contacts the front end of the pressing part 121, as shown in FIGS. 21 and 22. At this time, the contact protrusion 94 moves slightly from this starting position on the forward side in a direction opposite the mounting direction of the developer cartridge 32 (toward the front of the main casing 2). Further, the toothed part 92 of the sensor gear 85 moves from a position not engaged with the outer teeth of the third intermediate gear 83 (new product position) to a position engaged with the outer teeth of the third intermediate gear 83 (driving force transfer position).

At this time, contact with the contact protrusion 94 moves the third actuator 120 rearward against the urging force of the compression spring 126. The third actuator 120 pushes the free end of the swinging lever 105, causing the free end of the swinging lever 105 to pivot upward. As a result, the second switch 101 transmits an ON signal (contact signal) to the CPU 99. The third actuator 120 moves less in the rearward direction when the contact protrusion 94 is disposed in the forward position by the distance that the contact protrusion 94 in the forward position is farther forward than the contact protrusion 94 is the rearward position in order that the third actuator 120 does not contact the swinging lever 105 of the second switch 101.

Upon receiving an ON signal from the second switch 101, the CPU 99 determines that the developer cartridge 32 is a new product. Further, if an ON signal is received only from the second switch 101, then the CPU 99 determines that the maximum sheets to be printed by the new developer cartridge 32 is 3000. At this time, the CPU 99 resets the counter.

Hence, in the example shown in FIGS. 21 and 22, the CPU 99 determines that the developer cartridge 32 mounted in the main casing 2 is a new product and that the maximum sheets to be printed with the developer cartridge 32 is 3000 sheets. When the actual number of sheets detected by the paper discharge sensor 74 as having been printed since the developer cartridge 32 was mounted approaches 3000 sheets, the CPU 99 displays an out-of-toner message in a control panel or the like (not shown).

Further, when the developer cartridge 32 is mounted in the main casing 2, the sensor gear 85 can be driven to rotate, as described in the preferred embodiment. Hence, the sensor gear 85 is driven to rotate in an idle rotation operation.

Figure 24:
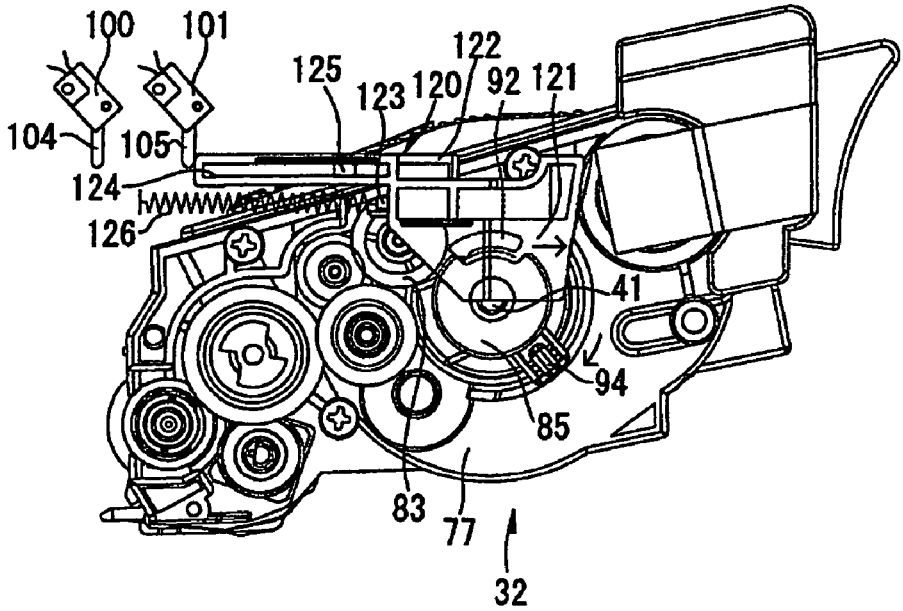
FIG. 24 is an explanatory diagram illustrating a mechanism according to the first variation of the embodiment for detecting a new developer cartridge having the structure shown in FIG. 20.

In the idle rotation operation, as shown in FIGS. 23 and 24, the sensor gear 85 is driven to rotate irreversibly in the clockwise direction about one-fourth of a rotation around the rotational shaft 41 from the upstream end to the downstream end in the direction of movement. Subsequently, the outer teeth of the third intermediate gear 83 disengage from the toothed part 92 of the sensor gear 85, halting the sensor gear 85 in a disengaged position (old product position).

As the sensor gear 85 is driven to rotate, the contact protrusion 94 integrally provided on the sensor gear 85 moves along the sensing window 97 of the sensor gear cover 96 irreversibly in the clockwise direction while describing an arc-shaped path from a midway position on the upper front side of the sensing window 97 toward an ending position located diagonally forward and downward.

At this time, the urging force of the compression spring 126 moves the third actuator 120 forward, allowing the swinging lever 105 of the second switch 101 to hang downward and prompting the second switch 101 to transmit an OFF signal (contact removed signal) to the CPU 99. Upon receiving an OFF signal from the second switch 101, the CPU 99 determines that the developer cartridge 32 is not a new product and increments the counter each time image formation is performed on a sheet until the second switch 101 inputs an ON signal.

Even if the developer cartridge 32 is mounted in the main casing 2 as a new product and is subsequently removed from the main casing 2 due to a paper jam or the like, the sensor gear 85 is maintained in a halted state in the old product position when the developer cartridge 32 is remounted in the main casing 2. Accordingly, the contact protrusion 94 of the sensor gear 85 does not contact the front end of the third actuator 120 when remounting the developer cartridge 32 and therefore the second switch 101 does not input an ON signal to the CPU 99. Accordingly, the CPU 99 does not mistake the remounted developer cartridge 32 as a new product, but continues to compare the number of sheets 3 on which images have actually been formed based on the counter reset when the developer cartridge 32 is determined to be new. The CPU 99 determines that the developer cartridge 32 has reached the end of its life just before the number of sheets on which images have actually been formed based on the counter approaches the maximum sheets to be printed, as described above.

(d) Effects of the method for detecting a new developer cartridge

In the first variation of the embodiment, the contact protrusion 94 disposed in the rearward position of the developer cartridge 32 and the contact protrusion 94 disposed in the forward position of the developer cartridge 32 are positioned relative to one another such that a first distance from the axial center of the rotational shaft 41 to the contact protrusion 94 in the rearward position is essentially the same as a second distance from the axial center of the rotational shaft 41 to the contact protrusion 94 disposed in the forward position. Accordingly, the sensing window 97 of the sensor gear cover 96 can be formed as a continuous path enabling the contact protrusion 94 to move in a circumferential path whether the contact protrusion 94 is initially disposed in the rearward position or in the forward position. This construction can simplify the design of the device.

Further, the relation of the contact protrusion 94 in the rearward position and the contact protrusion 94 in the forward position is such that a line segment connecting the contact protrusion 94 in the rearward position to the axial center of the agitator rotational shaft 41 forms an acute angle with a line segment connected to the contact protrusion 94 disposed in the forward position to the axial center of the agitator rotational shaft 41. Hence, it is possible to form a smaller gap between the contact protrusion 94 in the rearward position and the contact protrusion 94 in the forward position. In this way, a single third actuator 120 can be used to contact the contact protrusion 94 disposed in either position, thereby simplifying operations of detection by the first switch 100 and the second switch 101.

6. Second Variation

Though the contact protrusions are disposed at the upper position and at the lower position in the preferred embodiment, the contact protrusions are disposed in a position radially inward or outward from the sensor gear in the second variation.

Figure 27:
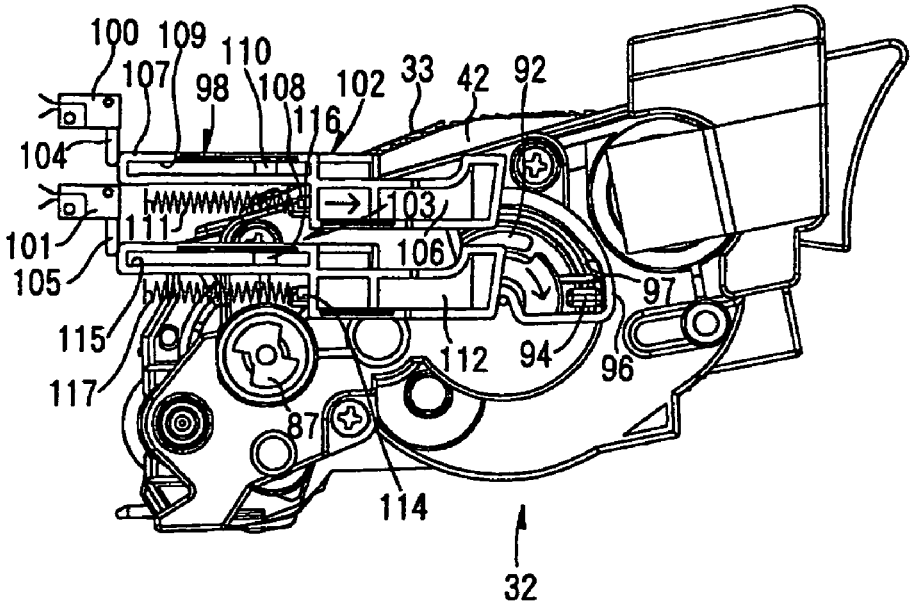
FIG. 27 is an explanatory diagram illustrating a mechanism according to the second variation of the embodiment for detecting a new developer cartridge having the structure shown in FIG. 3.
Figure 28:
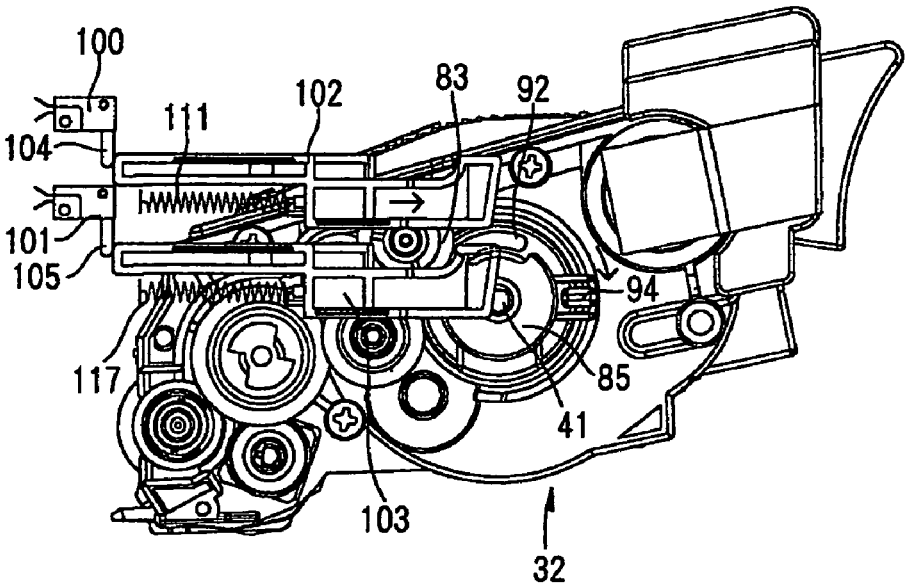
FIG. 28 is an explanatory diagram illustrating a mechanism according to the second variation of the embodiment for detecting a new developer cartridge having the structure shown in FIG. 4.
Figure 29:
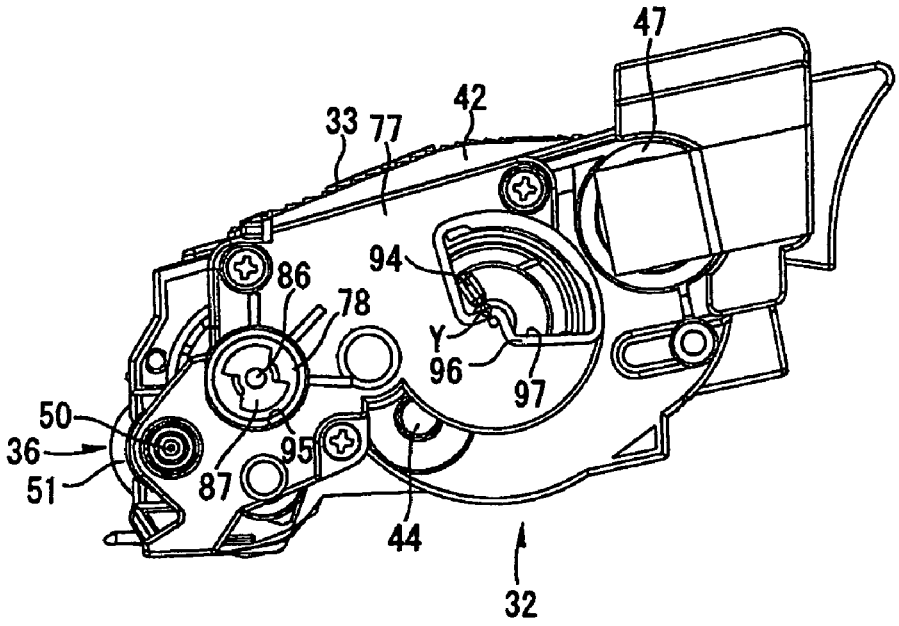
FIG. 29 is a side view of the developer cartridge in FIG. 2 according to the second variation of the embodiment when the contact protrusion is disposed on an inner side and the gear cover is mounted.
Figure 30:
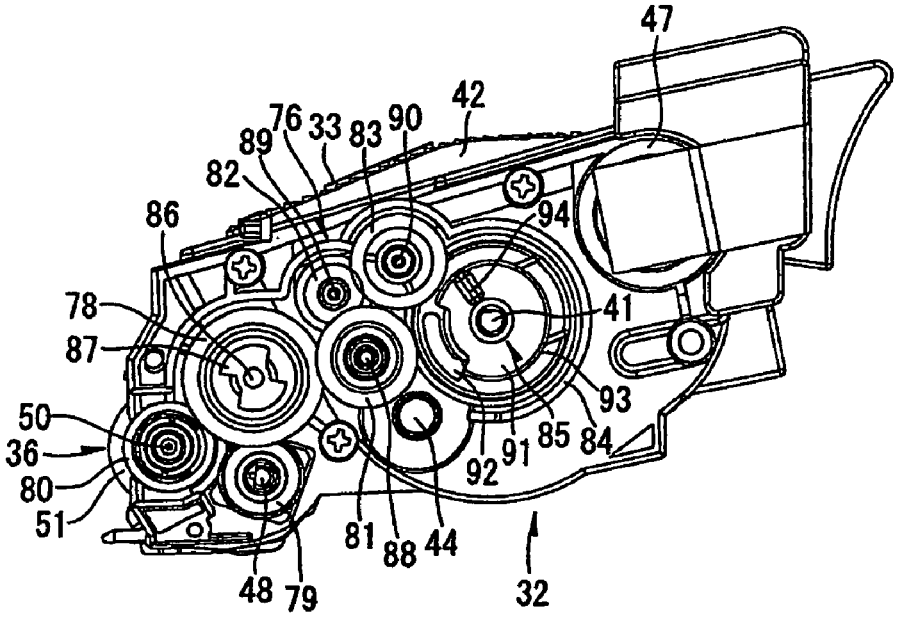
FIG. 30 is a side view of the developer cartridge in FIG. 2 according to the second variation of the embodiment when the contact protrusion is disposed on the inner side and the gear cover has been removed.

FIGS. 25 through 28 are explanatory diagrams illustrating a mechanism for detecting a new developer cartridge having the structure shown in FIGS. 3 and 4, where only the structure of the gear cover is changed to that shown in FIGS. 29 and 30. FIG. 29 is a side view of the developer cartridge, wherein the contact protrusion is disposed in an inner position and the gear cover is mounted. FIG. 30 is a side view of the developer cartridge, wherein the contact protrusion is disposed in the inner position, while the gear cover has been removed. FIGS. 31 through 34 are explanatory diagrams illustrating a mechanism for detecting a new developer cartridge having the structure shown in FIGS. 29 and 30. The following description of the second variation omits descriptions of structures identical to those shown in FIGS. 1 through 14 and only includes a description of structures that differ from the preferred embodiment.

(a) Structure of the developer cartridge

In the second variation of the preferred embodiment, the contact protrusion 94 is selectively disposed in a position radially inward or outward from the sensor gear 85.

More specifically, the developer cartridge 32 of the second variation has a similar structure to the developer cartridge 32 shown in FIGS. 3 and 4 when the starting position of the contact protrusion 94 is a first position on the outer side.

However, when the starting position of the contact protrusion 94 is in a second position on the inner side, the developer cartridge 32 includes the gear mechanism 76 having the same structure as that in the developer cartridge 32 shown in FIGS. 29 and 30 (in other words, the gear mechanism 76 does not include the fourth intermediate gear 118, and the outer teeth of the third intermediate gear 83 engage with the toothed part 92 of the sensor gear 85). However, in the sensor gear 85 shown in FIGS. 29 and 30, the contact protrusion 94 is positioned farther inward than the contact protrusion 94 in the developer cartridge 32 shown in FIGS. 3 and 4.

More specifically, the contact protrusion 94 disposed in the outer position shown in FIG. 3 and the contact protrusion 94 disposed in the inner position shown in FIG. 29 are positioned relative to each other such that a first distance from the axial center of the rotational shaft 41 to the contact protrusion 94 disposed in the outer position (indicated by X in FIG. 3) along the radial direction of the sensor gear 85 is greater than a second distance from the axial center of the rotational shaft 41 to the contact protrusion 94 disposed in the inner position (indicated by Y in FIG. 29). The contact protrusion 94 in the inner position is disposed between the axial center of the agitator rotational shaft 41 and the contact protrusion 94 in the outer position. Hence, the toothed part 92 moves in the same direction but along a different path when disposed in the outer position and the inner position and is lower when in the inner position than when in the outer position.

When in the outer position shown in FIGS. 3 and 4, the contact protrusion 94 corresponds to information indicating that the maximum sheets to be printed is 6000. When in the inner position shown in FIGS. 29 and 30, the contact protrusion 94 corresponds to information indicating that the maximum sheets to be printed is 3000.

Further, in the gear cover 77 according to the second variation, the sensing window 97 of the sensor gear cover 96 is formed substantially like a folding fan that. is wider in the radially direction of the sensor gear 85 in order to expose the contact protrusion 94 whether the contact protrusion 94 is in the inner position or the outer position. When the contact protrusion 94 is in the old product position, an enclosing plate (not shown) provided in the sensing window 97 contacts the contact protrusion 94 to maintain the sensor gear 85 in a halted state, even when the agitator rotational shaft 41 rotates relative to the sensor gear 85.

(b) Structure of the main casing

Figure 25:
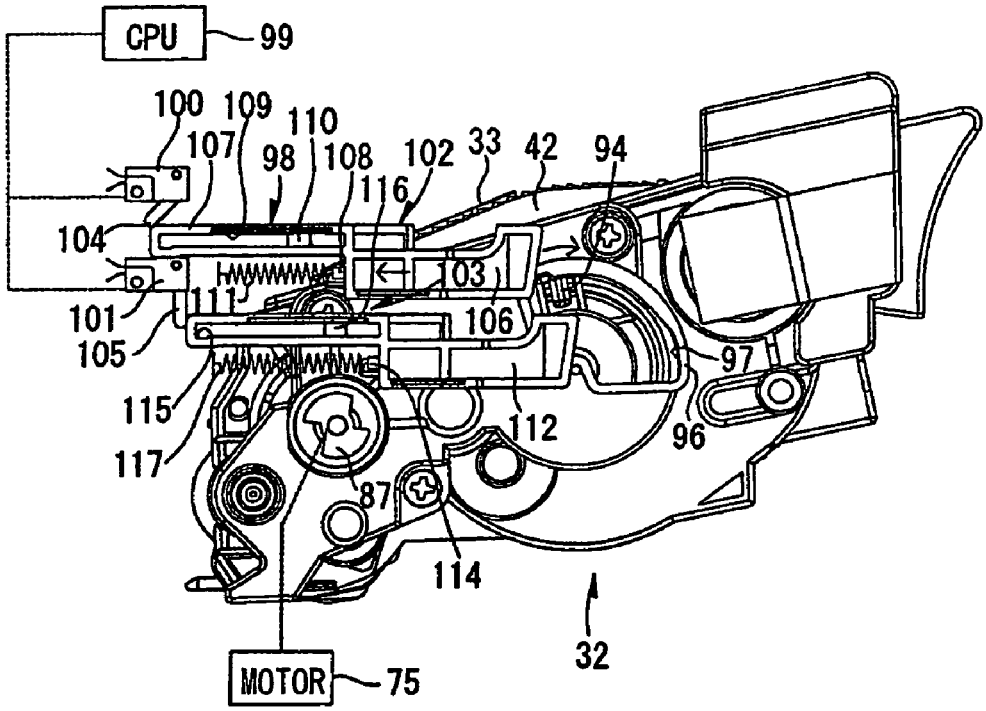
FIG. 25 is an explanatory diagram illustrating a mechanism according to a second variation of the embodiment for detecting a new developer cartridge having the structure shown in FIG. 3.

In the second variation, as shown in FIG. 25, the information-detecting mechanism 98 includes the first switch 100, the second switch 101, the first actuator 102, and the second actuator 103.

The first switch 100, second switch 101, first actuator 102, and second actuator 103 have the same structure as those described in the preferred embodiment. The first switch 100 and first actuator 102 are positioned so as to oppose the rear end of the contact protrusion 94 when the contact protrusion 94 is in the outer position. The second switch 101 and second actuator 103 are positioned so as to oppose the rear end of the contact protrusion 94 when the contact protrusion 94 is in the inner position. Specifically, the second switch 101 and second actuator 103 are positioned below the first switch 100 and first actuator 102. The first switch 100 and first actuator 102 and the second switch 101 and second actuator 103 are arranged parallel to each other in the front-to-rear direction.

(c) Operations for detecting a new developer cartridge

Next, a method according to the second variation will be described for determining whether a developer cartridge 32 mounted in the main casing 2 is old or new and for determining the maximum sheets to be printed by this developer cartridge 32.

(c-1) When the contact protrusion is disposed in the outer position

Figure 26:
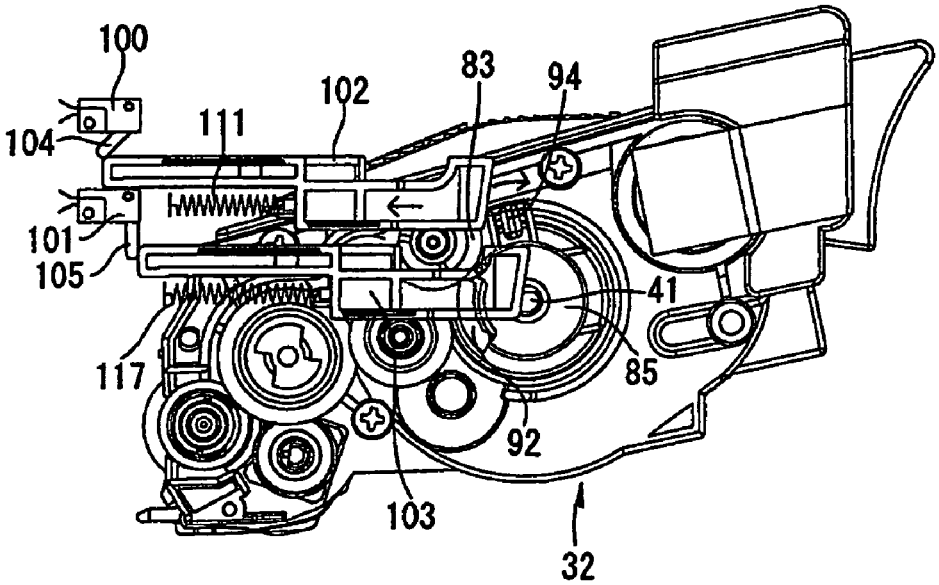
FIG. 26 is an explanatory diagram illustrating a mechanism according to the second variation of the embodiment for detecting a new developer cartridge having the structure shown in FIG. 4.

When a new developer cartridge 32 is mounted in the main casing 2, the contact protrusion 94 disposed in the outer position contacts the front end of the first actuator 102, as shown in FIGS. 25 and 26. At this time, the contact protrusion 94 moves slightly from this starting position on the rearward side in a direction opposite the mounting direction of the developer cartridge 32 (toward the front of the main casing 2). Further, the toothed part 92 of the sensor gear 85 moves from a position not engaged with the outer teeth of the third intermediate gear 83 (new product position) to a position engaged with the outer teeth of the third intermediate gear 83 (driving force transfer position).

At this time, contact with the contact protrusion 94 causes the first actuator 102 to move rearward against the urging force of the compression spring 111. The first actuator 102 pushes against the free end of the swinging lever 104, causing the free end to pivot upward. At this time, the first switch 100 transmits an ON signal (contact signal) to the CPU 99. Upon receiving an ON signal from the first switch 100, the CPU 99 determines that the developer cartridge 32 is new.

Further, the CPU 99 associates the ON signal inputted from the first switch 100 or the second switch 101 with information on the maximum sheets to be printed. Specifically, when an ON signal is inputted from the first switch 100, for example, the CPU 99 determines that the maximum sheets to be printed is 6000. When an ON signal is inputted from the second switch 101, the CPU 99 determines that the maximum sheets to be printed is 3000.

As described above, when an ON signal is inputted into the CPU 99 from first switch 100, as in the example shown in FIGS. 25 and 26, the CPU 99 determines that the developer cartridge 32 is a new product and that the maximum sheets to be printed with the developer cartridge 32 is 6000. At this time, the CPU 99 resets the counter.

Hence, in the example shown in FIGS. 25 and 26, the CPU 99 determines that the developer cartridge 32 mounted in the main casing 2 is a new product and that the maximum sheets to be printed with the developer cartridge 32 is 6000 sheets. When the actual number of sheets detected by the paper discharge sensor 74 as having been printed since the developer cartridge 32 was mounted approaches 6000 sheets, the CPU 99 displays an out-of-toner message in a control panel or the like (not shown).

Further, when the developer cartridge 32 is mounted in the main casing 2, the sensor gear 85 can be driven. to rotate, as described in the preferred embodiment. Hence, the sensor gear 85 is driven to rotate in an idle rotation operation.

In the idle rotation operation, as shown in FIGS. 27 and 28, the sensor gear 85 is driven to rotate irreversibly in the clockwise direction about one-fourth of a rotation around the rotational shaft 41 from the upstream end to the downstream end in the direction of movement. Subsequently, the outer teeth of the third intermediate gear 83 disengage from the toothed part 92 of the sensor gear 85, halting the sensor gear 85 in the disengaged position (old product position).

As the sensor gear 85 is driven to rotate, the contact protrusion 94 integrally provided on the sensor gear 85 moves along the sensing window 97 of the sensor gear cover 96 irreversibly in the clockwise direction while describing an arc-shaped path from a midway position on the upper rear side of the sensing window 97 toward an ending position located on the front side.

At this time, the urging force of the compression spring 111 moves the first actuator 102 forward, allowing the swinging lever 104 of the first switch 100 to hang downward and prompting the first switch 100 to transmit an OFF signal (contact removed signal) to the CPU 99. The CPU 99 determines that the developer cartridge 32 is not a new product and increments the counter each time image formation is performed on a sheet until the first switch 100 inputs an ON signal.

Even if the developer cartridge 32 is mounted in the main casing 2 as a new product and is subsequently removed from the main casing 2 due to a paper jam or the like, the sensor gear 85 is maintained in a halted state in the old product position when the developer cartridge 32 is remounted in the main casing 2. Accordingly, the contact protrusion 94 of the sensor gear 85 does not contact the front end of the first actuator 102 when remounting the developer cartridge 32 and therefore the first switch 100 does not input an ON signal to the CPU 99. Accordingly, the CPU 99 does not mistake the remounted developer cartridge 32 as a new product, but continues to compare the number of sheets 3 on which images have actually been formed based on the counter reset when the developer cartridge 32 is determined to be new. The CPU 99 determines that the developer cartridge 32 has reached the end of its life just before the number of sheets on which images have actually been formed based on the counter approaches the maximum sheets to be printed, as described above.

(c-2) When the contact protrusion is disposed in the inner position

Figure 31:
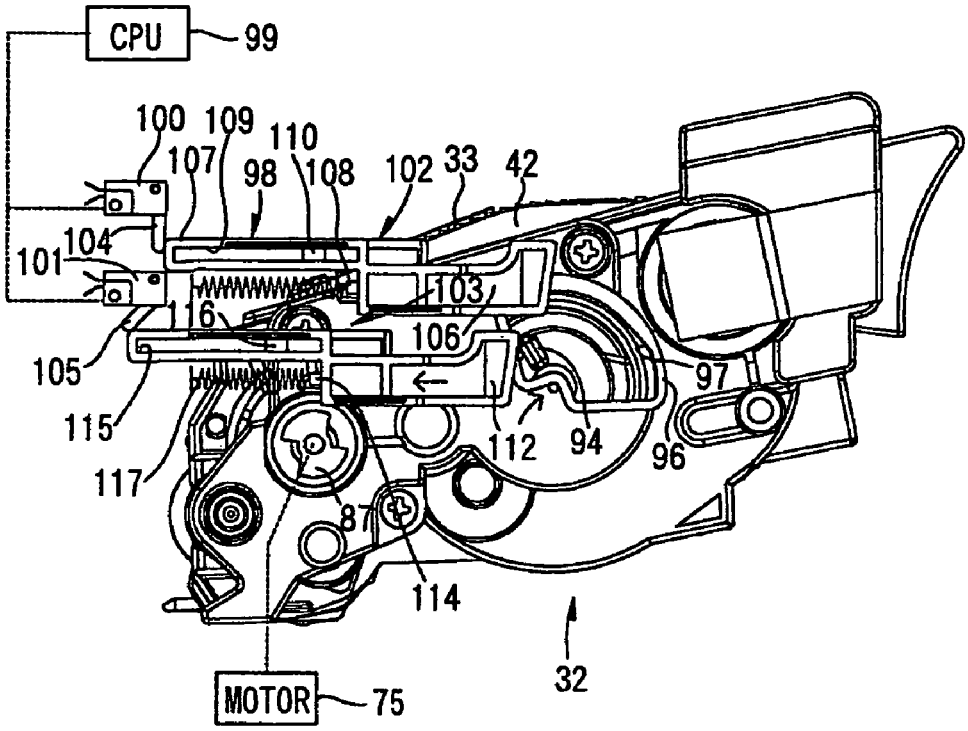
FIG. 31 is an explanatory diagram illustrating a mechanism according to the second variation of the embodiment for detecting a new developer cartridge having the structure shown in FIG. 29.
Figure 32:
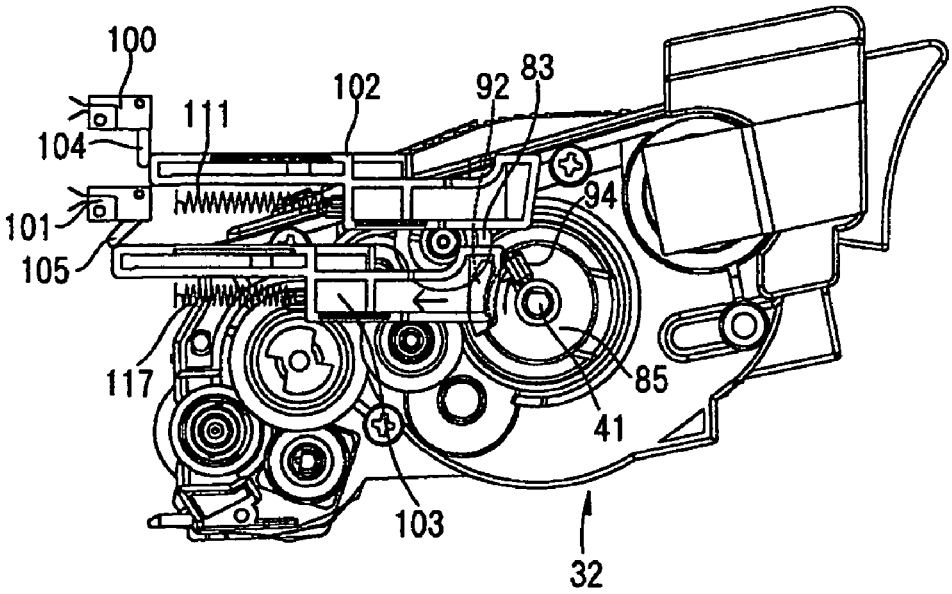
FIG. 32 is an explanatory diagram illustrating a mechanism according to the second variation of the embodiment for detecting a new developer cartridge having the structure shown in FIG. 30.

When a new developer cartridge 32 is mounted in the main casing 2, the contact protrusion 94 disposed in the inner position contacts the front end of the pressing part 112 on the second actuator 103, as shown in FIGS. 31 and 32. At this time, the contact protrusion 94 moves slightly from this starting position on the inner side in a direction opposite the mounting direction of the developer cartridge 32 (toward the front of the main casing 2). Further, the toothed part 92 of the sensor gear 85 moves from a position not engaged with the outer teeth of the third intermediate gear 83 (new product position) to a position engaged with the outer teeth of the third intermediate gear 83 (driving force transfer position).

At this time, contact with the contact protrusion 94 moves the second actuator 103 rearward against the urging force of the compression spring 117. The second actuator 103 pushes the free end of the swinging lever 105, causing the free end of the swinging lever 105 to pivot upward. As a result, the second switch 101 transmits an ON signal (contact signal) to the CPU 99.

Upon receiving an ON signal from the second switch 101, the CPU 99 determines that the developer cartridge 32 is a new product. Further, if an ON signal is received from the second switch 101, then the CPU 99 determines that the maximum sheets to be printed by the new developer cartridge 32 is 3000. At this time, the CPU 99 resets the counter.

Hence, in the example shown in FIGS. 31 and 32, the CPU 99 determines that the developer cartridge 32 mounted in the main casing 2 is a new product and that the maximum sheets to be printed with the developer cartridge 32 is 3000 sheets. When the actual number of sheets detected by the paper discharge sensor 74 as having been printed since the developer cartridge 32 was mounted approaches 3000 sheets, the CPU 99 displays an out-of-toner message in a control panel or the like (not shown).

Further, when the developer cartridge 32 is mounted in the main casing 2, the sensor gear 85 can be driven to rotate, as described in the preferred embodiment. Hence, the sensor gear 85 is driven to rotate in an idle rotation operation.

Figure 33:
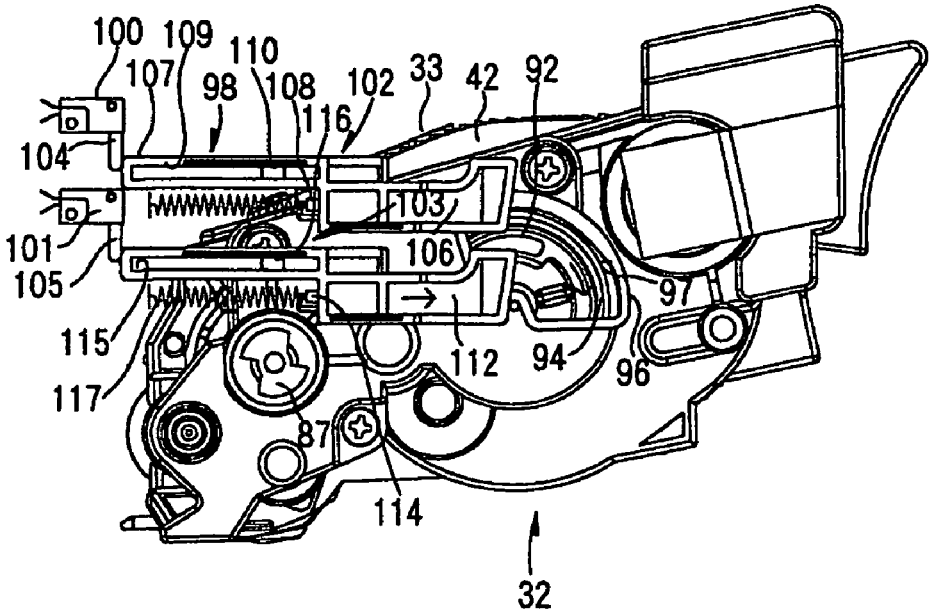
FIG. 33 is an explanatory diagram illustrating a mechanism according to the second variation of the embodiment for detecting a new developer cartridge having the structure shown in FIG. 29.
Figure 34:
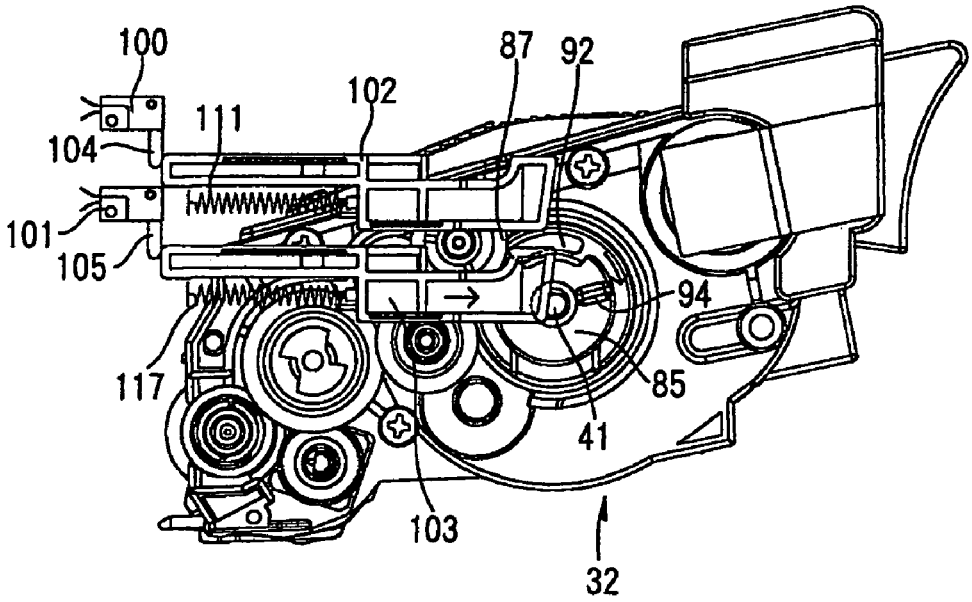
FIG. 34 is an explanatory diagram illustrating a mechanism according to the second variation of the embodiment for detecting a new developer cartridge having the structure shown in FIG. 30.

In the idle rotation operation, as shown in FIGS. 33 and 34, the sensor gear 85 is driven to rotate irreversibly in the clockwise direction about one-fourth of a rotation around the rotational shaft 41 from the upstream end to the downstream end in the direction of movement. Subsequently, the outer teeth of the third intermediate gear 83 disengage , from the toothed part 92 of the sensor gear 85, halting the sensor gear 85 in a disengaged position (old product position).

As the sensor gear 85 is driven to rotate, the contact protrusion 94 integrally provided on the sensor gear 85 moves along the sensing window 97 of the sensor gear cover 96 irreversibly in the clockwise direction and describes a shorter arc-shaped path than that described by the contact protrusion 94 in the outer position from a midway position on the upper rear side of the sensing window 97 toward an ending position on the front side.

At this time, the urging force of the compression spring 117 moves the second actuator 103 forward, allowing the swinging lever 105 of the second switch 101 to hang downward and prompting the second switch 101 to transmit an OFF signal (contact removed signal) to the CPU 99. The CPU 99 determines that the developer cartridge 32 is not a new product and increments the counter each time image formation is performed on a sheet until the second switch 101 inputs an ON signal.

Even if the developer cartridge 32 is mounted in the main casing 2 as a new product and is subsequently removed from the main casing 2 due to a paper jam or the like, the sensor gear 85 is maintained in a halted state in the old product position when the developer cartridge 32 is remounted in the main casing 2. Accordingly, the contact protrusion 94 of the sensor gear 85 does not contact the front end of the second actuator 103 when remounting the developer cartridge 32 and therefore the second switch 101 does not input an ON signal to the CPU 99. Accordingly, the CPU 99 does not mistake the remounted developer cartridge 32 as a new product, but continues to compare the number of sheets 3 on which images have actually been formed based on the counter reset when the developer cartridge 32 is determined to be new. The CPU 99 determines that the developer cartridge 32 has reached the end of its life just before the number of sheets on which images have actually been formed based on the counter approaches the maximum sheets to be printed, as described above.

(d) Effects of the method for detecting a new developer cartridge

In the second variation of the embodiment, the contact protrusion 94 disposed in the outer position of the developer cartridge 32 and the contact protrusion 94 disposed in the inner position of the developer cartridge 32 are positioned relative to one another such that a first distance from the axial center of the rotational shaft 41 to the contact protrusion 94 in the outer position along a radial direction of the sensor gear 85 is greater than a second distance from the axial center of the rotational shaft 41 to the contact protrusion 94 disposed in the inner position. Accordingly, it is possible to make the developer cartridge 32 more compact.

Further, the contact protrusion 94 disposed on the inner side is positioned between the axial center of the agitator rotational shaft 41 and the contact protrusion 94 disposed on the outer side. Therefore, the developer cartridge 32 can be made more compact, while facilitating the positioning of the contact protrusion 94.

7. Other Variations

In the preferred embodiment described above, the contact protrusion 94 is selectively disposed on the sensor gear 85 at one of a first position and a second position. However, the contact protrusion 94 may instead be disposed at both the first and second positions.

More specifically, in a third variation of the preferred embodiment, the contact protrusion 94 is disposed both at an inner position and an outer position, for example. The provision of contact protrusions 94 at both positions corresponds to information indicating that the maximum sheets to be printed is 9000.

Hence, when ON signals are inputted from both the first switch 100 and the second switch 101, the CPU 99 is configured to determine that the maximum sheets to be printed with the new developer cartridge 32 is 9000.

Hence, the laser printer 1 according to the third variation can determine three types of developer cartridges 32 having maximum sheets to be printed of 3000, 6000, and 9000. In the preferred embodiment and variations described above, a developer cartridge 32 is provided separately from the drum cartridge 31, and the photosensitive drum 55 is provided in the drum cartridge 31. However, it is obvious that the developer cartridge 32 according to the present invention may be formed integrally with the drum cartridge 31.

While the invention has been described in detail with reference to the specific embodiment thereof, it would be apparent to those skilled in the art that various changes and modifications may be made therein without departing from the spirit of the invention.

For example, the present invention is applicable to not only a monochromatic image-forming device in which a single developer cartridge is mountable but also a full-color image-forming device in which four cartridges separately accommodating yellow, magenta, cyan, and black toner are mountable.

What is claimed is:

1. An image-forming device comprising:

a body;

a developer cartridge accommodating developer therein and detachable from the body, the developer cartridge including an information member disposed, before the developer cartridge is mounted on the body, in at least one of a first position and a second position different from the first position in accordance with information with respect to the developer cartridge, the information member moving at a third position different from the first position and the second position after the developer cartridge is mounted on the body;

a first detecting unit that detects that the information member is disposed at the first position;

a second detecting unit that detects that the information member is disposed at the second position; and a controller that determines that the information member is disposed at the third position if neither the first detecting unit detects that the information member is disposed at the first position nor the second detecting unit detects that the information member is disposed at the second position, and judges the information with respect to the developer cartridge based on at least one of a detecting result of the first detecting unit, a detecting result of the second detecting unit, and a determining result of the controller.

2. The image-forming device according to claim 1, further comprising a driving unit that generates a driving force to move the information member from at least one of the first position and the second position when the developer cartridge is mounted on the body, wherein the developer cartridge includes a rotational shaft and a moving member on which the information member is provided, the moving member rotating around the rotational shaft when the driving force is transferred to the moving member.

3. The image-forming device according to claim 2, wherein the moving member rotates around the rotational shaft in opposite directions when disposed in the first position and when disposed in the second position.

4. The image-forming device according to claim 3, wherein the moving member includes a toothless gear having a toothed part and a toothless part.

5. The image-forming device according to claim 4, wherein the information member is disposed on the toothless gear.

6. The image-forming device according to claim 4, wherein the developer cartridge includes a driving force transferring unit that transfers the driving force to the moving member irreversibly, wherein the driving force transferring unit transfers the driving force to the moving member when the toothed part is coupled with the driving force transferring unit.

7. The image-forming device according to claim 6, wherein the driving force transferring unit includes a plurality of gears that transfers the driving force to the moving member, wherein a difference between the number of the gears when the information member is in the first position and the number of the gears when the information member is in the second position is an odd number.

8. The image-forming device according to claim 3, wherein the first position and the second position are set such that a first distance from the first position to the rotational shaft is substantially the same as a second distance from the second position to the rotational shaft.

9. The image-forming device according to claim 3, wherein the first position and the second position are set such that a line segment connecting the first position to the rotational shaft forms an obtuse angle with a line segment connecting the second position to the rotational shaft.

10. The image-forming device according to claim 9, wherein the first position and the second position are set such that a line segment connecting the first position and the second position passes over the rotational shaft.

11. The image-forming device according to claim 2, wherein the moving member rotates around the rotational shaft in the same direction when disposed in the first position and when disposed in the second position.

12. The image-forming device according to claim 11, wherein the moving member includes a toothless gear having a toothed part and a toothless part.

13. The image-forming device according to claim 12, wherein the information member is disposed on the toothless gear.

14. The image-forming device according to claim 12, wherein the developer cartridge includes a driving force transferring unit that transfers the driving force to the moving member irreversibly, wherein the driving force transferring unit transfers the driving force to the moving member when the toothed part is coupled with the driving force transferring unit.

15. The image-forming device according to claim 14, wherein the driving force transferring unit includes a plurality of gears that transfers the driving force to the moving member, wherein a difference between the number of the gears when the information member is in the first position and the number of the gears when the information member is in the second position is an odd number.

16. The image-forming device according to claim 11, wherein the first position and the second position are set such that a first distance from the first position to the rotational shaft is substantially the same as a second distance from the second position to the rotational shaft.

17. The image-forming device according to claim 11, wherein the first position and the second position are set such that a line segment connecting the first position to the rotational shaft forms an acute angle with a line segment connecting the second position to the rotational shaft.

18. The image-forming device according to claim 11, wherein the first position and the second position are set such that a first distance from the first position to the rotational shaft is greater than a second distance from the second position to the rotational shaft.

19. The image-forming device according to claim 18, wherein the first position and the second position are such that the second position is disposed between the rotational shaft and the first position.

20. The image-forming device according to claim 1, wherein the information with respect to the developer cartridge indicates whether the developer cartridge is a new product.

21. The image-forming device according to claim 1, wherein the information with respect to the developer cartridge indicates the maximum number of sheets of a recording medium on which images can be formed with the developer accommodated in the developer cartridge.

22. A developer cartridge detachable from an image-forming device, the developer cartridge comprising:

an accommodating member accommodating developer therein, and an information member disposed, before the developer cartridge is mounted on the image-forming device, in at least one of a first position and a second position different from the first position in accordance with information with respect to the developer cartridge, the information member moving at a third position different from the first position and the second position after the developer cartridge is mounted on the body, a position at which the information member is disposed being used to determine information with respect to the developer cartridge.

23. The developer cartridge according to claim 22, further comprising:

a rotational shaft; and a moving member on which the information member is provided, the moving member rotating around the rotational shaft when a driving force is transferred to the moving member.

24. The developer cartridge according to claim 23, wherein the moving member rotates around the rotational shaft in opposite directions when disposed in the first position and when disposed in the second position.

25. The developer cartridge according to claim 24, wherein the moving member includes a toothless gear having a toothed part and a toothless part.

26. The developer cartridge according to claim 25, wherein the information member is disposed on the toothless gear.

27. The developer cartridge according to claim 25, further comprising a driving force transferring unit that transfers the driving force to the moving member irreversibly, wherein the driving force transferring unit transfers the driving force to the moving member when the toothed part is coupled with the driving force transferring unit.

28. The developer cartridge according to claim 27, wherein the driving force transferring unit includes a plurality of gears that transfers the driving force to the moving member, wherein a difference between the number of the gears when the information member is in the first position and the number of the gears when the information member is in the second position is an odd number.

29. The developer cartridge according to claim 24, wherein the first position and the second position are set such that a first distance from the first position to the rotational shaft is substantially the same as a second distance from the second position to the rotational shaft.

30. The developer cartridge according to claim 24, wherein the first position and the second position are set such that a line segment connecting the first position to the rotational shaft forms an obtuse angle with a line segment connecting the second position to the rotational shaft.

31. The developer cartridge according to claim 30, wherein the first position and the second position are set such that a line segment connecting the first position and the second position passes over the rotational shaft.

32. The developer cartridge according to claim 23, wherein the moving member rotates around the rotational shaft in the same direction when disposed in the first position and when disposed in the second position.

33. The developer cartridge according to claim 32, wherein the moving member includes a toothless gear having a toothed part and a toothless part.

34. The developer cartridge according to claim 33, wherein the information member is disposed on the toothless gear.

35. The developer cartridge according to claim 33, further comprising a driving force transferring unit that transfers the driving force to the moving member irreversibly, wherein the driving force transferring unit transfers the driving force to the moving member when the toothed part is coupled with the driving force transferring unit.

36. The developer cartridge according to claim 35, wherein the driving force transferring unit includes a plurality of gears that transfers the driving force to the moving member, wherein a difference between the number of the gears when the information member is in the first position and the number of the gears when the information member is in the second position is an odd number.

37. The developer cartridge according to claim 32, wherein the first position and the second position are set such that a first distance from the first position to the rotational shaft is substantially the same as a second distance from the second position to the rotational shaft.

38. The developer cartridge according to claim 32, wherein the first position and the second position are set such that a line segment connecting the first position to the rotational shaft forms an acute angle with a line segment connecting the second position to the rotational shaft.

39. The developer cartridge according to claim 32, wherein the first position and the second position are set such that a first distance from the first position to the rotational shaft is greater than a second distance from the second position to the rotational shaft.

40. The developer cartridge according to claim 39, wherein the first position and the second position are such that the second position is disposed between the rotational shaft and the first position.

41. The developer cartridge according to claim 22, wherein the information with respect to the developer cartridge indicates whether the developer cartridge is a new product.

42. The developer cartridge according to claim 22, wherein the information with respect to the developer cartridge indicates the maximum number of sheets of a recording medium on which images can be formed with the developer accommodated in the developer cartridge.

43. An image-forming device comprising:

a body;

a developer cartridge accommodating developer therein and detachable from the body, the developer cartridge including an information member disposed, before the developer cartridge is mounted on the body, in at least one of a first position and a second position different from the first position in accordance with information with respect to the developer cartridge, the information member moving at a third position different from the first position and the second position after the developer cartridge is mounted on the body;

a first detecting unit that detects that the information member is disposed at the first position;

a second detecting unit that detects that the information member is disposed at the second position;

a third detecting unit that detects that the information member is disposed at the third position; and a controller that determines the information with respect to the developer cartridge based on a detecting result of at least one of the first detecting unit, the second detecting unit, and the third detecting unit.

44. The image-forming device according to claim 43, wherein the first detecting unit includes a first switching unit that turns on when the developer cartridge is mounted on the body, the first detecting unit detecting that the information member is disposed at the first position if the first switching unit turns on, wherein the second detecting unit includes a second switching unit that turns on when the developer cartridge is mounted on the body, the second detecting unit detecting that the information member is disposed at the second position if the second switching unit turns on, and wherein the third detecting unit detects that the information member is disposed at the third position if neither the first detecting unit detects that the information member is disposed at the first position nor the second detecting unit detects that the information member is disposed at the second position.

* * * * *